US010368182B2

(12) United States Patent
Gurkin et al.

(10) Patent No.: US 10,368,182 B2
(45) Date of Patent: Jul. 30, 2019

(54) DEVICE AND METHOD OF MODIFYING AN AUDIO OUTPUT OF THE DEVICE

(71) Applicant: YANDEX EUROPE AG, Lucerne (CH)

(72) Inventors: Roman Vladimirovich Gurkin, Moscow (RU); Konstantin Igorievich Kruglov, Moscow (RU)

(73) Assignee: YANDEX EUROPE AG, Lucerne (CH)

( * ) Notice: Subject to any disclaimer, the term of this patent is extended or adjusted under 35 U.S.C. 154(b) by 0 days.

(21) Appl. No.: 16/022,775

(22) Filed: Jun. 29, 2018

(65) Prior Publication Data

US 2019/0200153 A1 Jun. 27, 2019

(30) Foreign Application Priority Data

Dec. 27, 2017 (RU) ..... 2017146273

(51) Int. Cl.
*H04R 5/02* (2006.01)
*H04S 7/00* (2006.01)
(Continued)

(52) U.S. Cl.
CPC ..... *H04S 7/301* (2013.01); *H04R 1/24* (2013.01); *H04R 5/02* (2013.01); *H04R 5/04* (2013.01);
(Continued)

(58) Field of Classification Search
CPC ..... H04S 7/301; H04S 3/008; H04R 1/24; H04R 5/02; H04R 5/04
See application file for complete search history.

(56) References Cited

U.S. PATENT DOCUMENTS 2,694,462 A 11/1954 Frank et al.
3,327,808 A 6/1967 Shaper
(Continued)

FOREIGN PATENT DOCUMENTS

CN 202602769 U 12/2012
CN 106297815 A 1/2017
JP 2007181099 A 7/2007

OTHER PUBLICATIONS

English Abstract for CN106297815 retrieved on Espacenet on Feb. 14, 2018.

(Continued)

*Primary Examiner* — Simon King
(74) *Attorney, Agent, or Firm* — BCF LLP

(57) ABSTRACT

A method of selectively modifying an initial audio output of a device that has at least two speakers is provided. The method comprises detecting a volume level of the initial audio output; comparing the volume level to a threshold; based on the comparison, controlling reproduction of the initial audio output by a selective execution of: (i) responsive to the volume level being inferior to the threshold, transmitting an identical audio signal to each one of the speakers for reproducing a modified audio output being of a mono audio output type; and (ii) responsive to the volume level being superior to the threshold, transmitting respective audio signals to the speakers for reproducing the modified audio output, the respective audio signals being different from one another and where the modified audio output is of a stereo audio output type.

19 Claims, 14 Drawing Sheets

(51) Int. Cl.

| | |
|---|---|
| ***H04R 5/04*** | (2006.01) |
| ***H04R 1/24*** | (2006.01) |
| ***H04S 3/00*** | (2006.01) |

(52) U.S. Cl.

CPC ..... *H04S 3/008* (2013.01); *H04S 2400/01* (2013.01); *H04S 2400/13* (2013.01)

(56) References Cited

U.S. PATENT DOCUMENTS

| | | | | |
|---|---|---|---|---|
| 3,329,235 | A | 7/1967 | Shaper | |
| 3,818,138 | A | 6/1974 | Sperrazza | |
| 4,574,906 | A | 3/1986 | White et al. | |
| 5,712,957 | A | 1/1998 | Waibel et al. | |
| 6,701,294 | B1 | 3/2004 | Ball et al. | |
| 7,925,004 | B2 | 4/2011 | Hodges et al. | |
| 7,953,456 | B2 | 5/2011 | Romesburg et al. | |
| 8,140,335 | B2 | 3/2012 | Kennewick et al. | |
| 8,219,394 | B2 | 7/2012 | Flaks et al. | |
| 8,401,178 | B2 | 3/2013 | Chen et al. | |
| 8,914,277 | B1 | 12/2014 | Liu | |
| 8,935,163 | B2 | 1/2015 | Huang et al. | |
| 8,971,543 | B1 | 3/2015 | List | |
| 9,001,994 | B1 | 4/2015 | Yang | |
| 9,060,224 | B1 | 6/2015 | List | |
| 9,087,520 | B1 | 7/2015 | Salvador | |
| 9,113,264 | B2 | 8/2015 | Frater | |
| 9,288,331 | B2 | 3/2016 | Mauchly et al. | |
| 9,324,322 | B1 | 4/2016 | Torok et al. | |
| 9,351,059 | B1 | 5/2016 | Suhre | |
| 9,595,997 | B1 | 3/2017 | Yang | |
| 9,628,910 | B2 | 4/2017 | Zurek et al. | |
| 9,641,919 | B1 | 5/2017 | Poole et al. | |
| 2008/0080723 | A1* | 4/2008 | Kim | H04H 60/04 381/119 |
| 2009/0203344 | A1* | 8/2009 | Hanawalt | H04B 1/1676 455/311 |
| 2010/0036667 | A1 | 2/2010 | Byford et al. | |
| 2014/0140537 | A1* | 5/2014 | Soulodre | H03G 5/005 381/104 |
| 2015/0012829 | A1 | 1/2015 | Brown et al. | |
| 2015/0256953 | A1* | 9/2015 | Kwatra | H04R 5/04 381/58 |
| 2017/0140755 | A1 | 5/2017 | Andreas et al. | |

OTHER PUBLICATIONS

English Abstract for JP2007181099 retrieved on Espacenet on Feb. 14, 2018.

English Abstract for CN202602769 retrieved on Espacenet on Feb. 14, 2018.

Vergnes, "Interactive Assistant for Activities of Daily Living", IOS Press, Canada, 2003, pp. 1-8.

Sundblad et al., "Olga—a Multimodal Interactive Information Assistant", CID—Center for User Oriented IT Design, Sweden, 2 pages, bladhttps://www.semanticscholar.org/paper/OLGA-a-multimodal-interactive-information-assistant-Sundblad-Sundblad/6f9c6b7e09947c34ae54fcc29b38d96a71acc7c5.

* cited by examiner

DEVICE AND METHOD OF MODIFYING AN AUDIO OUTPUT OF THE DEVICE

CROSS-REFERENCE

The present application claims priority to Russian Patent Application No. 2017146273, entitled "A Device and Method of Modifying an Audio Output of the Device", filed Dec. 27, 2017, the entirety of which is incorporated here by reference.

TECHNICAL FIELD

The present technology relates generally to modifying an audio output of a device.

BACKGROUND

There are many electronic devices that are capable of processing and outputting audio (i.e. audio devices). These devices include: smart-phones, tablets, audio players, and the like. These electronic devices can have transducers such as speakers and microphones. A microphone is usually configured to pick up an audio input for the device and the speaker is usually configured to reproduce an audio output by the device. An audio output may be representative of a song or other types of audio recordings while an audio input may be representative of ambient sounds and/or spoken utterances, such as words spoken by an operator of the electronic device, that occur in proximity of the microphone.

Conventional audio devices routinely employ computer-implemented techniques for identifying words spoken by the operator based on various features of a received audio input. These techniques, usually referred to as speech recognition techniques or automatic speech recognition (ASR), are combined with natural language processing techniques and allow the operator to control the audio device to perform tasks based on the operator's spoken commands.

In some instances, the operator may be located in a noisy environment when she/he submits spoken commands to the audio device for performing various tasks and, thus, the microphone may pick up, not only the spoken utterances of the operator, but also the ambient sounds of the noisy environment in which the operator is located. As such, the audio device may not be able to recognize the operator's spoken commands and, therefore, may not be able to perform the tasks that the operator desires it to perform.

Thus, there is a need for devices that are able to recognize operator spoken commands with more ease.

SUMMARY

One object of the present technology is to ameliorate at least some of the inconveniences of the prior art.

In a first broad aspect of the present technology, there is provided a method of selectively modifying an initial audio output of a device. The device comprises at least two speakers communicatively coupled to a processor. The method comprises detecting, by the processor, a volume level of the initial audio output reproducible by the at least two speakers. The method comprises comparing, by the processor, the volume level to a volume level threshold. The method comprises, based on the comparison of the volume level to the volume level threshold, controlling, by the processor, reproduction of the initial audio output by the at least two speakers. The controlling of the reproduction is done by a selective execution of: (i) responsive to the volume level being inferior to the volume level threshold, transmitting, by the processor, an identical audio signal to each one of the at least two speakers for reproducing a modified audio output where the modified audio output is of a mono audio output type; and (ii) responsive to the volume level being superior to the volume level threshold, transmitting, by the processor, respective audio signals to the at least two speakers for reproducing the modified audio output where the respective audio signals are different from one another and where the modified audio output is of a stereo audio output type.

In some implementations of the method, the initial audio output is of the mono audio output type.

In some implementations of the method, the initial audio output is of the stereo audio output type.

In some implementations of the method, the detecting the volume level of the initial audio output comprises analyzing at least one audio signal transmitted to the at least two speakers for reproducing the initial audio output.

In some implementations of the method, the device further comprises a microphone communicatively coupled to the processor. The method also comprises, based on the comparison of the volume level to the volume level threshold and responsive to the volume level being superior to the volume level threshold, muting, by the processor, the microphone.

In some implementations of the method, muting the microphone comprises executing, by the processor, software muting of the microphone.

In some implementations of the method, muting the microphone further comprises executing, by the processor, hardware muting of the microphone.

In some implementations of the method, the modified audio output reproducible by the at least two speakers being of the stereo audio output type has a broader range of audio frequencies than the modified audio output reproducible by the at least two speakers being of the mono audio output type.

In some implementations of the method, the volume level threshold is predetermined based on at least a volume level of speech of an operator of the device.

In some implementations of the method, the method further comprises providing to an operator of the device a visual indication of a type of the modified audio output.

In another broad aspect of the present technology, there is provided a device that has a speaker chassis having a top, a bottom and sidewalls, the sidewalls including two opposite sidewalls each having an aperture. The device also has at least two speakers where each of the two speakers are inserted into a respective aperture of opposite sidewalls such that each one of the at least two speakers is facing outwardly from the speaker chassis. The device also has a processor connected to the speaker chassis and is communicatively coupled to the at least two speakers. The processor configured to (i) transmit at least one audio signal to the at least two speakers for reproducing an initial audio output by the at least two speakers, (ii) detect a volume level of the initial audio output, (iii) compare the volume level to a volume level threshold, and (iv) based on a comparison of a volume level of the initial audio output to the volume level threshold, control the reproduction of the initial audio output. The processor is configured to control reproduction by selectively transmitting: (i) responsive to the volume level being inferior to the volume level threshold, an identical audio signal to each one of the at least two speakers for reproducing a modified audio output where the modified audio output is of a mono audio output type and (ii) responsive to the volume level being superior to the volume level threshold, respective audio signals to the at least two speakers for reproducing the modified audio output where the respective audio signals are different from one another and where the modified audio output is of a stereo audio output type.

In some implementations of the device, the device further comprises a top assembly connected to the top of the speaker chassis and communicatively coupled to the processor. The top assembly is configured to receive indications of haptic interactions of an operator with the top assembly.

In some implementations of the device, the top assembly comprises a microphone communicatively coupled to the processor and, based on the comparison of the volume level to the volume level threshold and responsive to the volume level being superior to the volume level threshold, the processor is further configured to mute the microphone.

In some implementations of the device, the processor is configured to execute software muting of the microphone.

In some implementations of the device, the processor is configured to execute hardware muting of the microphone.

In some implementations of the device, the modified audio output reproducible by the at least two speakers being of the stereo audio output type has a broader range of audio frequencies than the modified audio output reproducible by the at least two speakers being of the mono audio output type.

In some implementations of the device, the volume level threshold is predetermined based on at least an audible volume level of speech of the operator of the device by the microphone.

In some implementations of the device, the top assembly further provides to the operator of the device a visual indication of a type of the modified audio output.

In some implementations of the device, the device further comprises a low-frequency speaker connected to the bottom of the speaker chassis such that the low-frequency speaker is facing downwardly from the speaker chassis and where the processor is communicatively coupled to the low-frequency speaker.

For purposes of this application, terms related to spatial orientation such as forwardly, rearwardly, upwardly, downwardly, left, and right, are as they would normally be understood by a user or operator of the device. Terms related to spatial orientation when describing or referring to components or sub-assemblies of the device, separately from the device should be understood as they would be understood when these components or sub-assemblies are mounted to the device.

Implementations of the present technology each have at least one of the above-mentioned aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of implementations of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
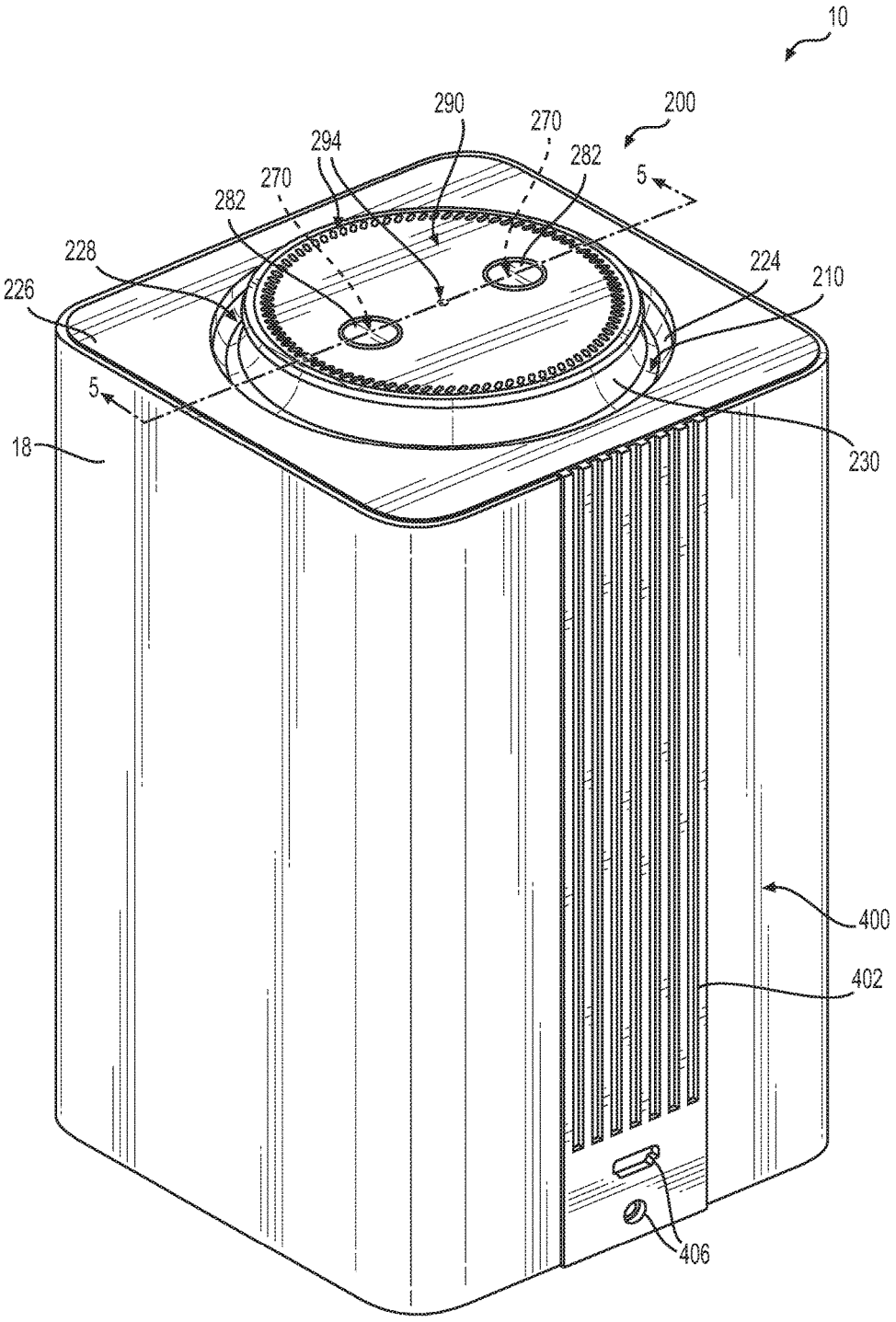
FIG. 1 is a perspective view, taken from a top, rear, left side, of a device.
Figure 8:
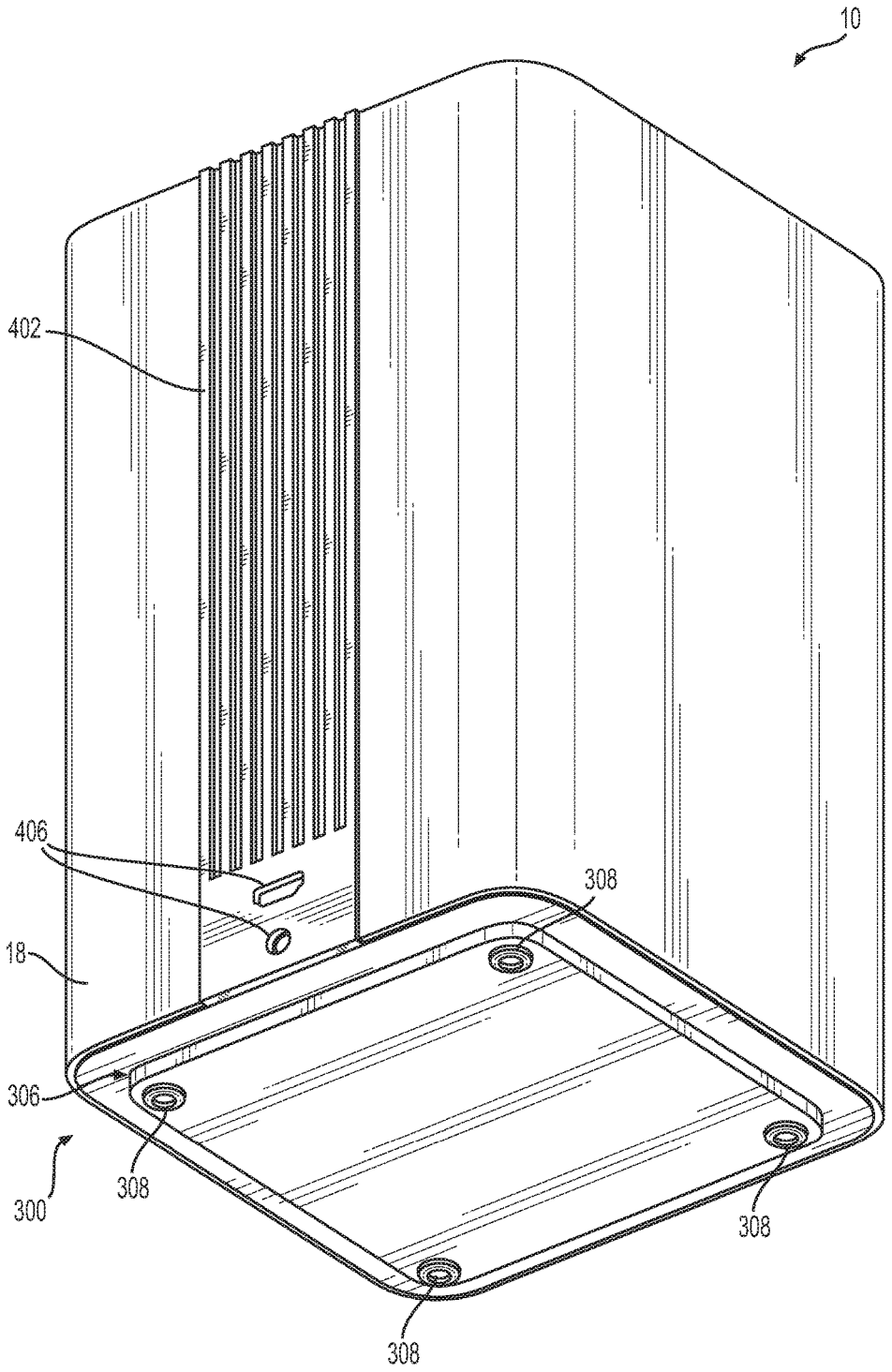
FIG. 8 is a perspective view, taken from a bottom, rear, right side, of the device of FIG. 1.
Figure 10:
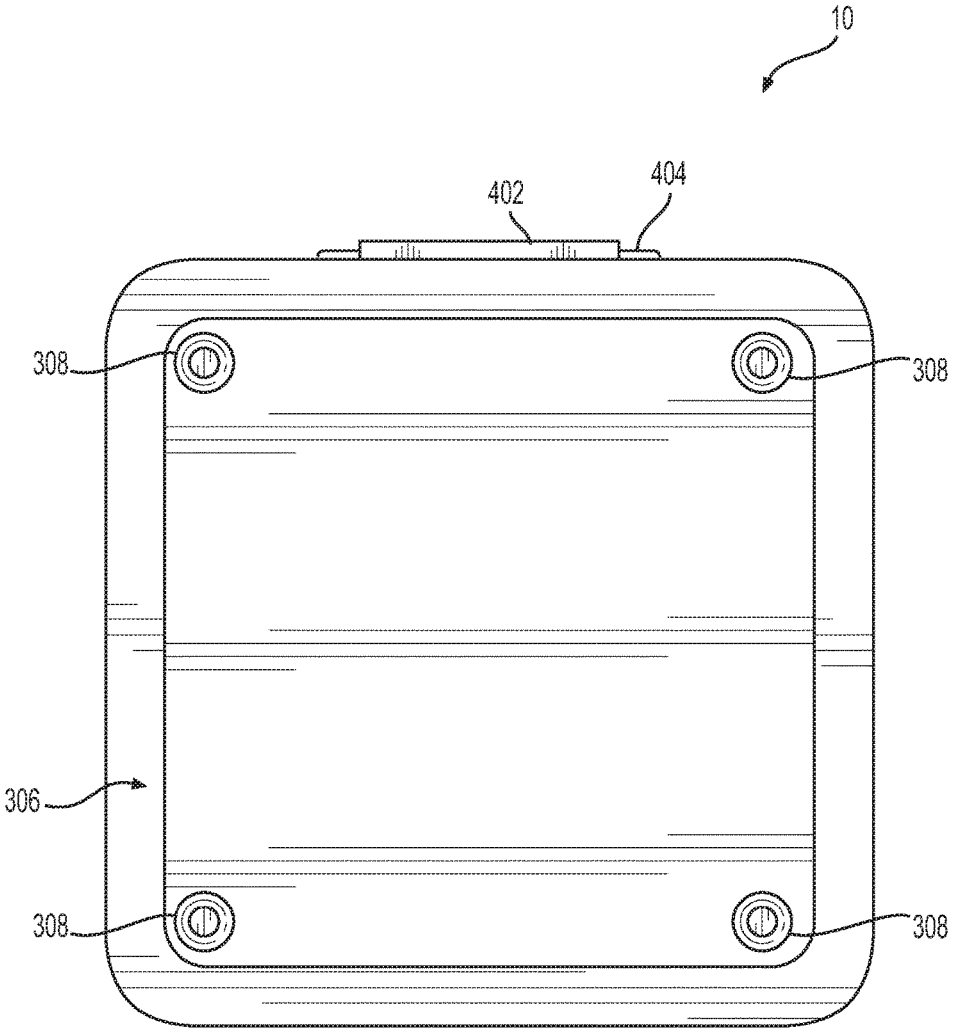
FIG. 10 is a bottom side view of the device of FIG. 2.

With reference to FIGS. 1, 8 and 10, a device 10 has a top, a bottom and four sides. The device 10 can be positioned by an operator of the device 10 on a support surface, such as a table (not depicted), for example. Generally speaking, the device 10 is configured to (i) reproduce audio outputs being representative of, for example, songs that the operator wants to hear, (ii) capture audio inputs which can be representative of spoken utterances of the operator and (iii) perform tasks based on operator's commands.

The device 10 has a top assembly 200. Generally speaking, the top assembly 200 is configured to (i) receive and transmit indications of haptic interactions of the operator of the device 10 with the top assembly 200, (ii) capture and transmit indication of audio inputs of the device 10 and (iii) provide visual indications to the operator. Components of the top assembly 200, their assembly, and how the top assembly 200 is configured to (i) receive and transmit indications of haptic interactions of the operator, (ii) capture and transmit indication of audio inputs of the device 10 and (iii) provide visual indications to the operator will be further described herein below.

The device 10 also has a support panel 402 at the back thereof. The support panel 402 forms a plurality of ports 406 located near the bottom thereof. The plurality of ports 406 allows connecting the device 10 to an electrical power source and with other electronic devices (not depicted) using a wired connection. It is contemplated that the support panel 402 may have additional ports without departing from the scope of the present technology. The support panel 402 is enveloped by a cover 18 that is positioned about the device 10 for protecting internal components of the device 10 from its environment.

Figure 2:
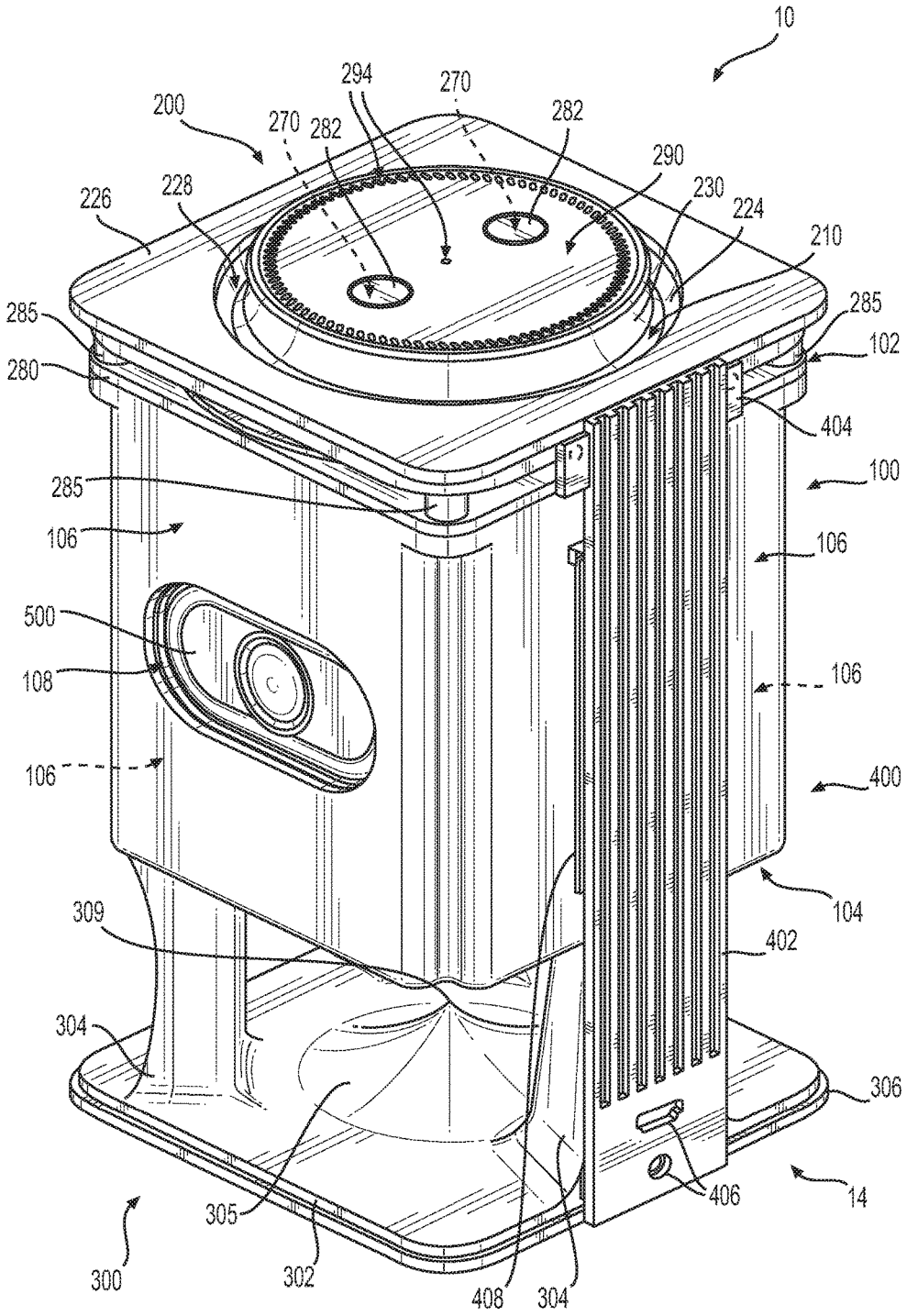
FIG. 2 is a perspective view, taken from a top, rear, left side, of the device without a cover thereof.
Figure 4:
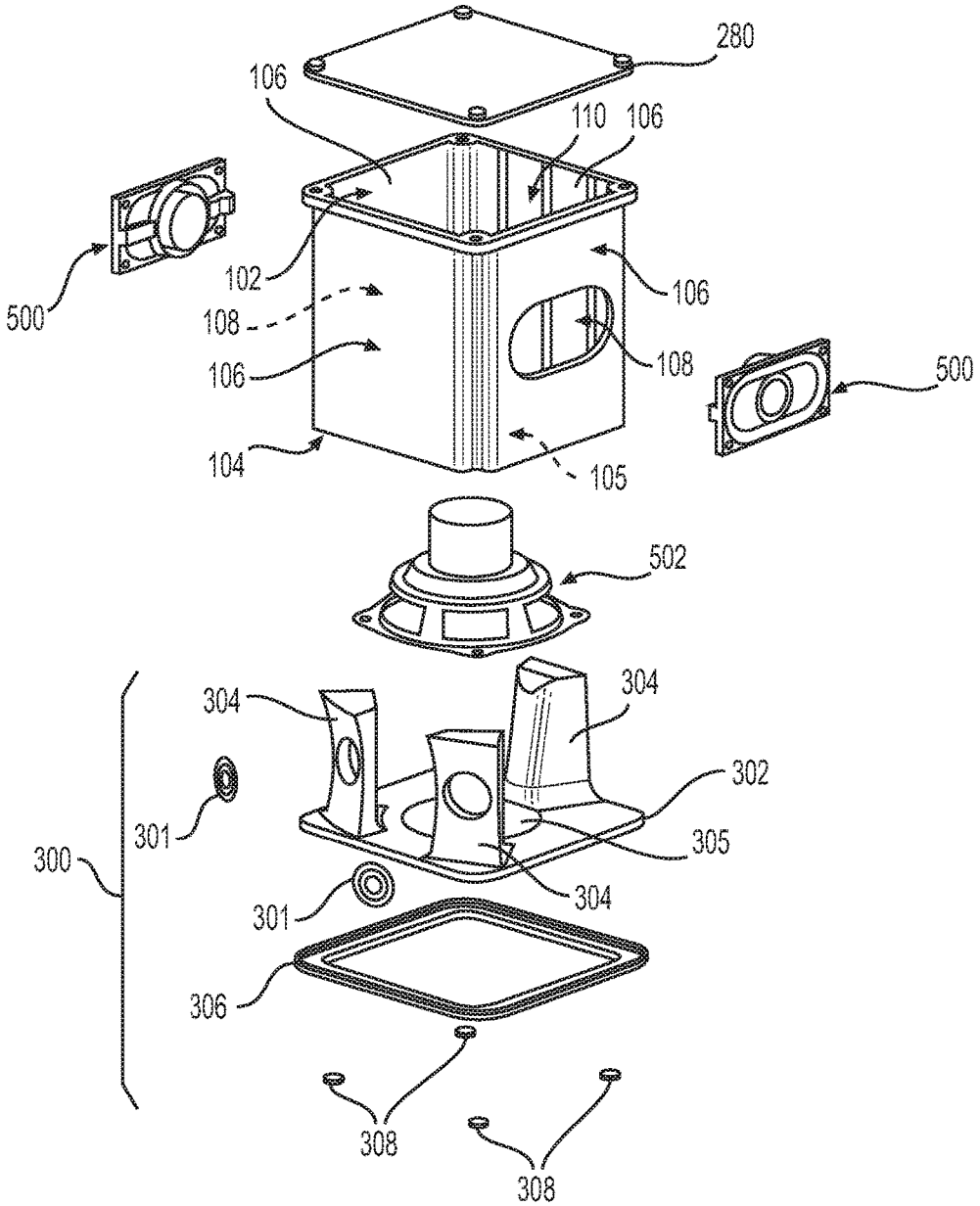
FIG. 4 is a partially exploded perspective view, taken from a top, front, left side, showing at least some other components of the device of FIG. 1.
Figure 9:
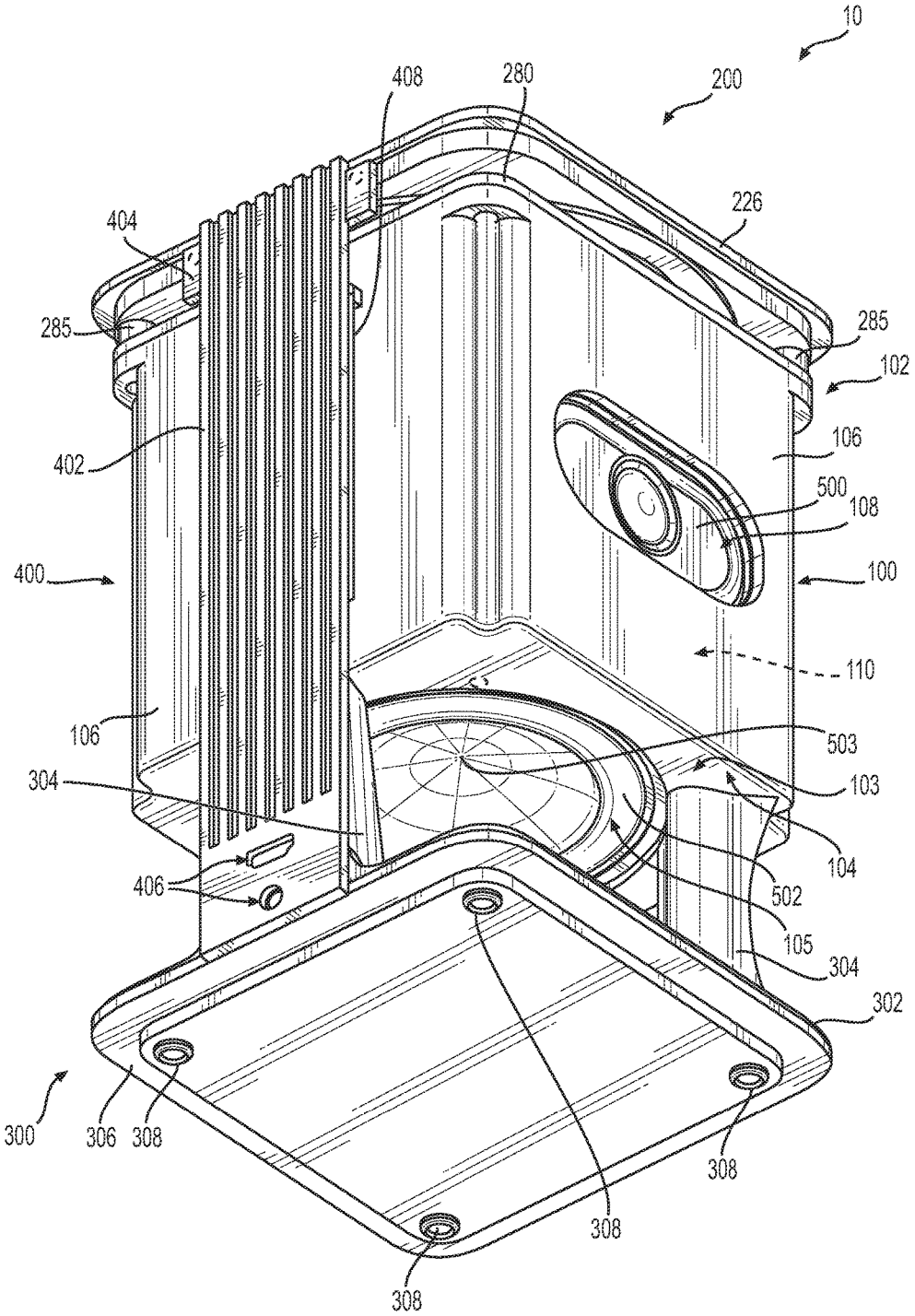
FIG. 9 is a perspective view, taken from a bottom, rear, right side, of the device of FIG. 2.

The device 10 also has a bottom assembly 300. With reference to FIGS. 2, 4 and 9, the bottom assembly 300 includes a bottom assembly chassis 302. The bottom assembly chassis 302 has three support beams 304 and a concave parabolic cone protrusion 305 which extends upwardly from the bottom assembly chassis 302.

The bottom assembly chassis 302, the support beams 304 and the concave parabolic cone protrusion 305 are integrally formed; however, this may not be the case in each and every embodiment of the present technology. For example, the support beams 304 and the concave parabolic cone protrusion 305 may be formed separately from the bottom assembly chassis 302 and attached on top of the bottom assembly chassis 302.

Two of the support beams 304 protrude from the bottom assembly chassis 302 near a respective corner thereof at the front of the bottom assembly chassis 302, while the other one of the support beams 304 protrudes at the back of the bottom assembly chassis 302. The support beams 304 protruding at the front of the bottom assembly chassis 302 are adapted to support beepers 301 (see FIG. 4). It is contemplated that the bottom assembly chassis 302 may comprise a different number of support beams 304 such as one, two or more than three support beams 304 in other embodiments of the present technology.

The bottom assembly 300 also includes a base 306 attached to the bottom of the bottom assembly chassis 302. The base 306 is adapted for housing a port circuit structure 409 (see FIG. 5). The bottom assembly also includes base pads 308 attached to the bottom of the base 306 near corners of the base 306 as best seen in FIG. 10. The base pads 308 increase friction with the support surface on which the device 10 is positioned. It is contemplated, however, that the base 306 and/or the base pads 308 may be omitted in some embodiments of the present technology.

In embodiments where the base 306 is omitted, it is contemplated that the support beams 304 protruding at the back of the bottom assembly chassis 302 may be adapted for housing the port circuit structure 409.

Returning to FIGS. 2 and 4, the device 10 also has a device body in the form of a frame or a speaker chassis 100 which has a top 102, a bottom 104 and four sidewalls 106. The four sidewalls 106 are enveloped by the cover 18 (see FIG. 1) of the device 10 when assembled. The sidewalls 106 of the speaker chassis 100 include two lateral sidewalls 106 each defining a respective aperture 108 for accommodating speakers 500 of the device 10. The bottom 104 of the speaker chassis 100 defines an aperture 105 for accommodating a low-frequency speaker 502 of the device 10.

The device 10 also has a top attachment panel 280. The top attachment panel 280 is vertically located between the top assembly 200 and the speaker chassis 100 for attaching the top assembly 200 to the speaker chassis 100. It is contemplated that the speaker chassis 100 and the top attachment panel 280 may be integrally formed in some embodiments of the present technology.

The device 10 also has a support member 404. The support member 404 is sandwiched between the top assembly 200 and the support panel 402 and attaches the support panel 402 to the top assembly 200. The support member 404 is also adapted to connect and support the cover 18 around the device 10.

As previously mentioned, the device 10 also has transducers, such as the speakers 500 and the low-frequency speaker 502, for reproducing audio outputs by the device 10. Generally speaking, a given audio output is a combination of sound waves having various audio frequencies. The speakers 500 are tweeters or treble speakers that are designed to generate sound waves of generally high audio frequencies of the given audio output. The low-frequency speaker 502 is a woofer that is designed to generate sound waves of generally low audio frequencies of the given audio output.

The device 10 also has the beepers 301 for reproducing audible indications of at least some operations of the device 10 such as, but not limited to: turn on/off operations, standby mode on/off operations, mute operations and the like.

The device 10 also has a device-operation unit 400. The device-operation unit 400 has a processor 408 and the port circuit structure 409 (see FIG. 5). When the device 10 is assembled, the processor 408 is communicatively coupled with the top assembly 200, the speakers 500, the low-frequency speaker 502, the beepers 301 and the port circuit structure 409.

It should be noted that, in some embodiments of the present technology, the processor 408 may comprise one or more processors and/or one or more microcontrollers configured to execute instructions and to carry out operations associated with the operation of the device 10. In various embodiments, the processor 408 may be implemented as a single-chip, multiple chips and/or other electrical components including one or more integrated circuits and printed circuit boards. The processor 408 may optionally contain a cache memory unit (not depicted) for temporary local storage of instructions, data, or additional computer information. By way of example, the processor 408 may include one or more processors or one or more controllers dedicated for certain processing tasks of the device 10 or a single multifunctional processor or controller.

Moreover, explicit use of the term "processor" or "controller" should not be construed to refer exclusively to hardware capable of executing software, and may implicitly include, without limitation, digital signal processor (DSP) hardware, network processor, application specific integrated circuit (ASIC), field programmable gate array (FPGA), read-only memory (ROM) for storing software, random access memory (RAM), and non-volatile storage. Other hardware, conventional and/or custom, may also be included.

Components of the top assembly 200 and how the top assembly 200 is assembled will now be described.

Figure 3:
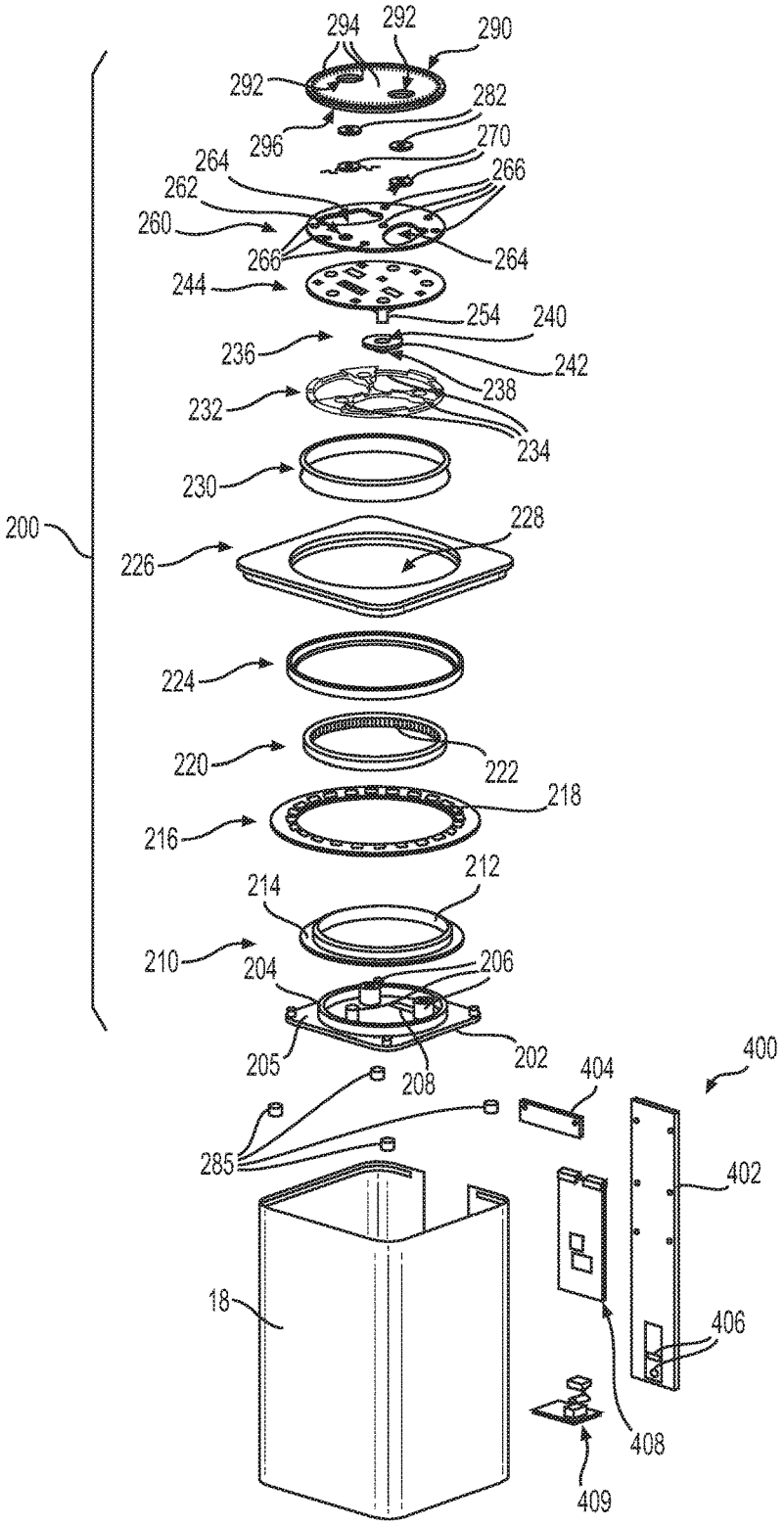
FIG. 3 is a partially exploded perspective view, taken from a top, front, left side, showing at least some components of the device of FIG. 1.
Figure 5:
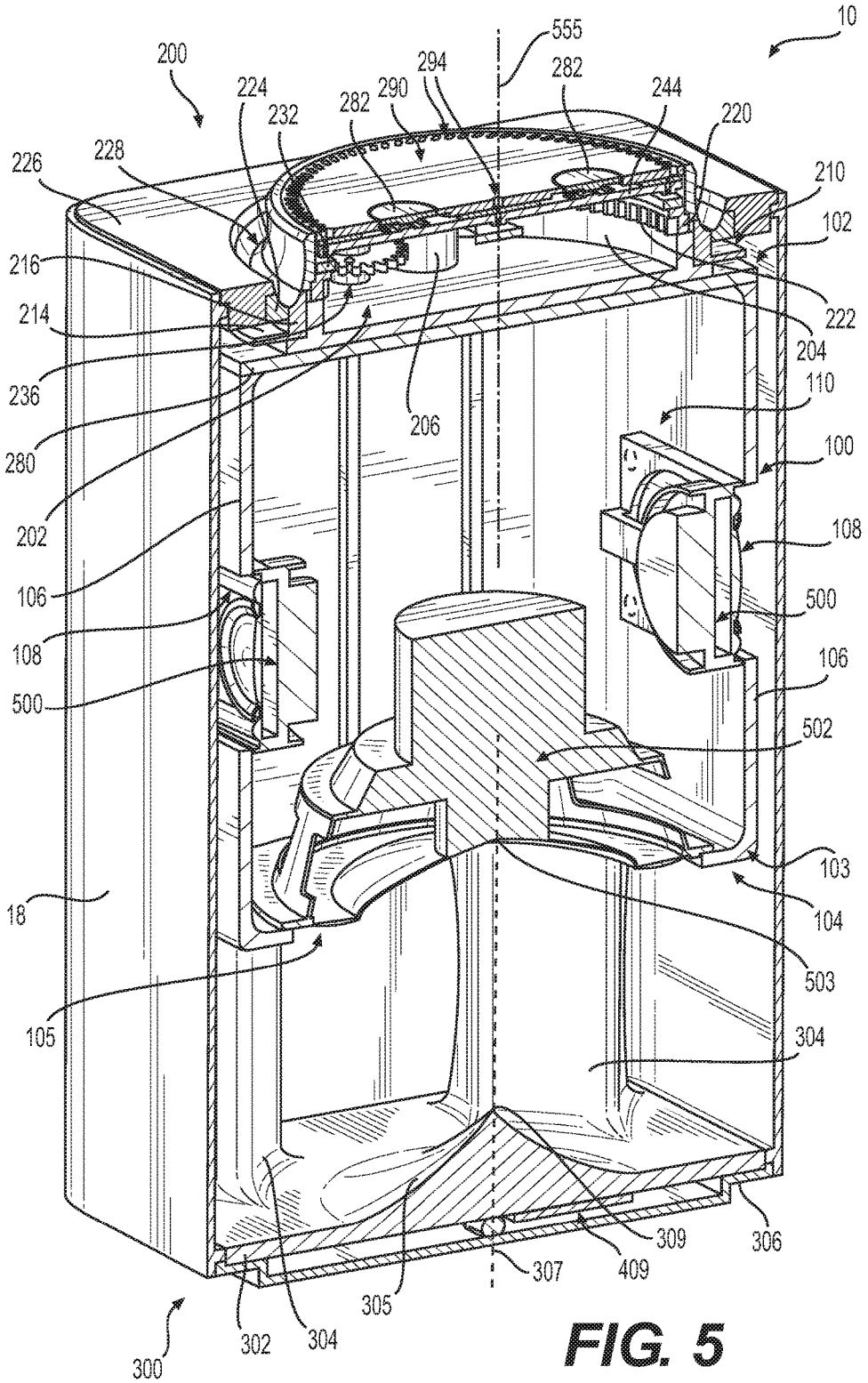
FIG. 5 is a cross-sectional view of the device of FIG. 1 taken through a line 5-5 depicted in FIG. 1.

With reference to FIGS. 3 and 5, the top assembly 200 includes a top assembly chassis 202. The top assembly chassis 202 has an upwardly extending annular protrusion 204 which protrudes from a top surface 205. The top assembly chassis 202 also has three upwardly extending cylindrical protrusions 206 which protrude from the top surface 205 and extend above the annular protrusion 204. It is contemplated that at least one of the cylindrical protrusions 206 may extend above the other cylindrical protrusions 206. The top assembly chassis 202 also defines a bus aperture 208 for cabling providing communicative coupling between the processor 408 and at least some components of the top assembly 200. The cylindrical protrusions 206 and the bus aperture 208 of the top assembly chassis 202 are located inside the annular protrusion 204.

The top assembly 200 also includes an annular support member 210 having a horizontal portion 214 and a vertical portion 212. The annular support member 210 is sized such that, when the annular protrusion 204 is received by the vertical portion 212, the vertical portion 212 is frictionally attached to the annular protrusion 204. When the annular support member 210 is frictionally attached to the annular protrusion 204, the annular protrusion 204 and the annular support member 210 are concentric with one another.

The top assembly 200 also includes a light-emission ring 216 with a plurality of light emitting diodes (LEDs) 218 located on top thereof. The light-emission ring 216 is sized such that when it rests on the horizontal portion 214, the light-emission ring encircles the vertical portion 212. The vertical portion 212 aids in aligning the light-emission ring 216 and the top assembly chassis 202 during assembly of the device 10 while the horizontal portion 214 supports the light-emission ring 216.

The top assembly 200 also includes an inner socket roller 220. The inner socket roller 220 is positioned on top of the annular protrusion 204 and is concentric therewith. The inner socket roller 220 can rotate about a vertical axis 555 (see FIG. 5) with respect to the annular protrusion 204. The inner socket roller 220 has a plurality of gear teeth 222 extending radially inwardly towards the vertical axis 555 for transmitting rotational motion of the inner socket roller 220 to a pinion mechanism 236 (see FIG. 5) when the inner socket roller 220 rotates.

The top assembly 200 also includes a light-diffusing ring 224 which is concentric with the light-emission ring 216 and is positioned above the light-emission ring 216. The light-diffusing ring 224 is sized such that it receives the vertical portion 212 and is positioned about the annular support member 210 when the vertical portion 212 is received. The light-diffusing ring 224 also connects a top panel 226 about the annular support member 210. The light-diffusing ring 224 allows diffusing the light emitted by the plurality of LEDs 218.

The top assembly 200 also includes the top panel 226 which defines a circular aperture 228. The top assembly chassis 202 is attached to the bottom of the top panel 226 such that the annular support member 210, the light-emission ring 216 and the light-diffusing ring 224 are sandwiched between the top panel 226 and the top assembly chassis 202. The light-diffusing ring 224 is concentric with the circular aperture 228 and is at least partially visible along its circumference through the circular aperture 228 for providing visual indications to the operator of the device 10.

The top assembly 200 also includes a side-ring 230 which is concentric with the circular aperture 228. The side-ring 230 is inserted through the circular aperture 228 and is affixed to the inner socket roller 220. As such, the side-ring 230 transfers its rotational motion to the inner socket roller 220 when the side-ring 230 rotates about the vertical axis 555. The side-ring 230 has a concave vertical profile for accommodating operator's fingers when the operator rotates the side-ring 230 about the vertical axis 555 which provides additional grip for the operator's fingers during rotation of the side-ring 230.

The top assembly 200 also includes a locking member 232 which has three apertures 234. The apertures 234 are sized to receive a respective cylindrical protrusion 206 of the top assembly chassis 202. The apertures 234 allow aligning the locking member 232 with the top assembly chassis 202 for attaching the locking member 232 to the top assembly chassis 202. When the locking member 232 is inserted through the side-ring 230 and the cylindrical protrusions 206 are received by the respective apertures 234, the locking member 232 is attached to the top assembly chassis 202. When the locking member 232 is attached to the top assembly chassis 202, the inner socket roller 220 as well as the side-ring 230 affixed to the inner socket roller 220 are prevented from vertical movement.

The top assembly 200 also includes the pinion mechanism 236 which has a cylindrical vertical axel 238 and a horizontal gear 240 having a plurality of gear teeth 242. The cylindrical vertical axel 238 is rotationally attached to the top surface 205 of the top assembly chassis 202 inside the annular protrusion 204 so as to allow a rotational movement of the pinion mechanism 236 when driven by the inner socket roller 220. When the cylindrical vertical axel 238 is rotationally attached to the top surface 205 of the top assembly chassis 202, the horizontal gear 240 is vertically aligned with the inner socket roller 220. The horizontal gear 240 is sized such that the gear teeth 242 of the horizontal gear 240 are cooperatively engaged with the gear teeth 222 of the inner socket roller 220.

Figure 11:
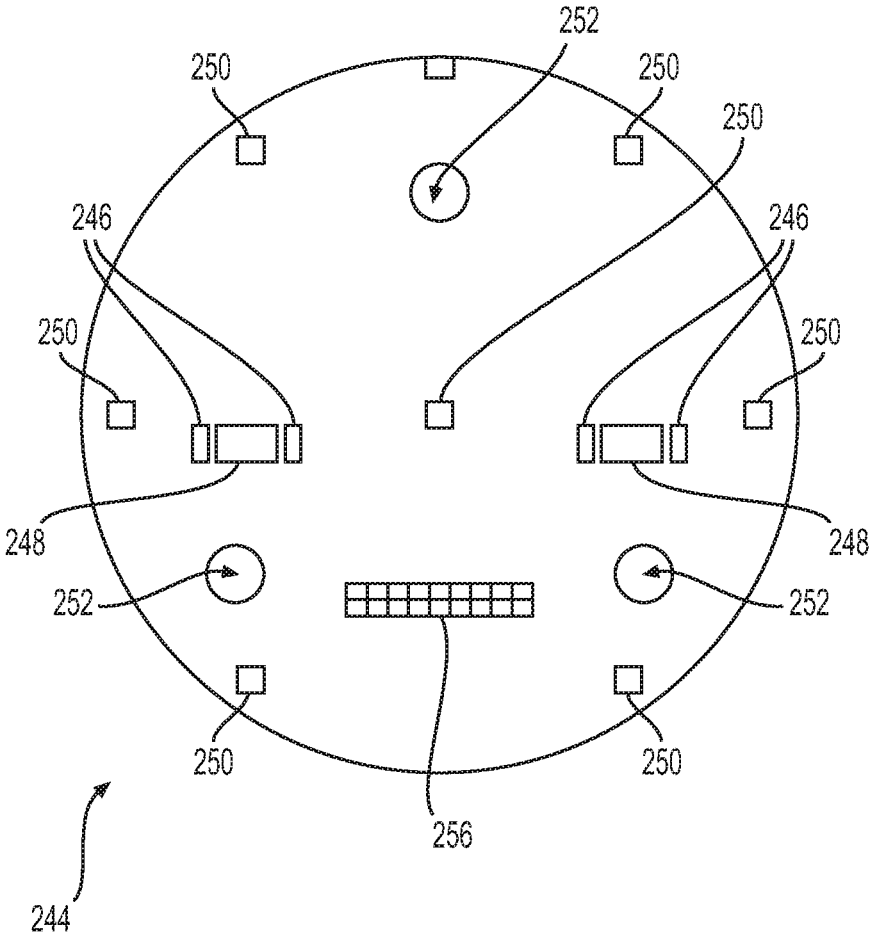
FIG. 11 is a top side view of a circuit panel of the device.
Figure 12:
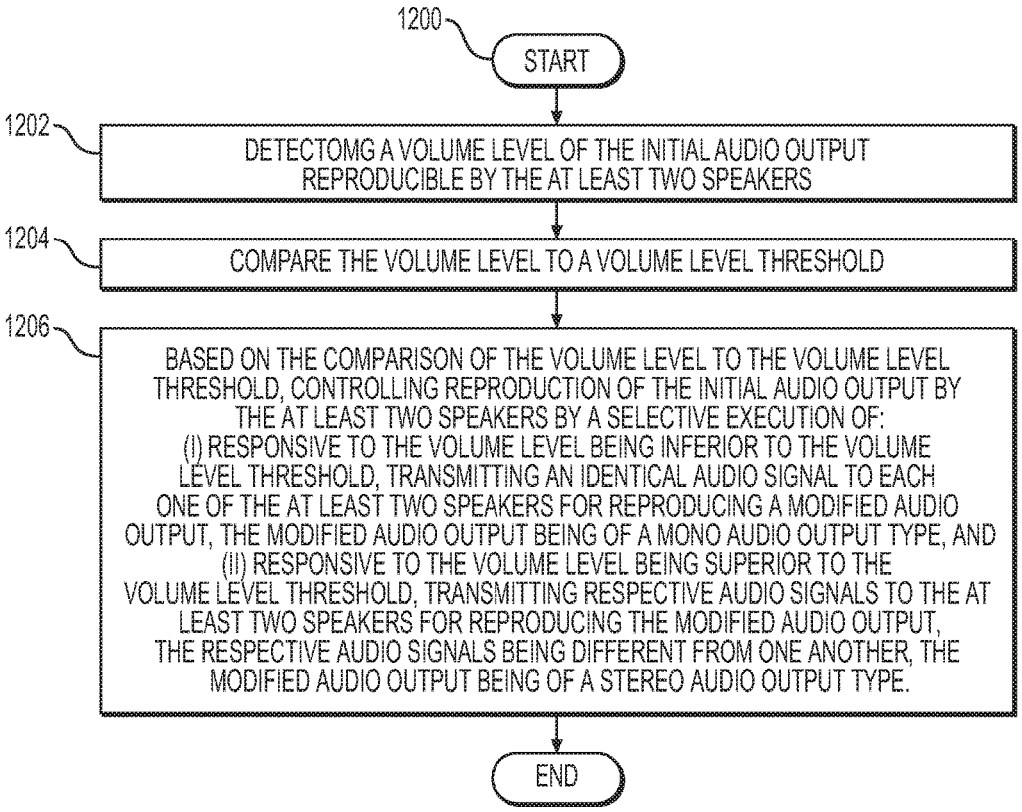
FIG. 12 is a block diagram of a method, the method being implemented in accordance with non-limiting embodiments of the present technology, the method executable by the device.

With reference to FIGS. 3 and 11, the top assembly 200 also includes a circuit panel 244 having three apertures 252. The apertures 252 are sized to receive a respective cylindrical protrusion 206 and allow aligning the circuit panel 244 with the top assembly chassis 202 for attaching the circuit panel 244 to the top assembly chassis 202 during assembly of the top assembly 200. The circuit panel 244 has a port 256 for communicatively coupling the circuit panel 244 to the processor 408. The circuit panel 244 also has a downwardly extending sensing rod 254 which is positioned such that, when the circuit panel 244 is attached to the top assembly chassis 202, the sensing rod 254 is horizontally aligned with the cylindrical vertical axel 238 and is inserted in the pinion mechanism 236. The sensing rod 254 cooperates with the pinion mechanism 236 for detecting an angular position of the pinion mechanism 236.

The circuit panel 244 also has a plurality of button LEDs 246 and two button sensors 248. The circuit panel 244 also has the plurality of microphones 250 that are affixed to the top of the circuit panel 244. One of the plurality of microphones 250 is located in the center of the circuit panel 244 and the other ones of the plurality of microphones 250 are located near the edge of the circuit panel 244 and about the center of the circuit panel 244. It is contemplated that the plurality of microphones 250 can comprise fewer than or more than seven microphones 250.

The top assembly 200 also comprises a pad 260 which has an aperture 262, button apertures 264 and microphone apertures 266. The aperture 262 is sized to receive a cylindrical protrusion 206 and allows aligning the pad 260 with the top assembly chassis 202 for attaching the pad 260 to the top assembly chassis 202 during assembly. The pad 260 is also affixed on top of the circuit panel 244. When the pad 260 is affixed to the top of the circuit panel 244, the button apertures 264 are horizontally aligned with the plurality of button LEDs 246 and the button sensors 248. When the pad 260 is affixed to the top of the circuit panel 244, the microphone apertures 266 are horizontally aligned with the plurality of microphones 250 so as not to block the plurality of microphones 250 by the pad 260.

The top assembly 200 also comprises buttons 270 and button covers 282. The buttons 270 are attached to the pad 260 and are horizontally aligned with the button apertures 264. The button covers 282 are attached on top of the buttons 270.

The top assembly 200 also comprises a cap panel 290 which has button apertures 292 and microphone apertures 294. The microphone apertures 294 channel the given audio input to the plurality of microphones 250. The cap panel 290 also has an attachment member 296 for aligning the cap panel 290 with the top assembly chassis 202 and for attaching the cap panel 290 to the cylindrical protrusion 206.

When the top assembly 200 is assembled, the button covers 282 are horizontally aligned and are flush with the cap panel 290.

Now that the components of the top assembly 200 and the assembly of the top assembly 200 have been described, the assembly of the device 10 will be described and, more specifically, the assembly of the speaker chassis 100, the top assembly 200, the bottom assembly 300, the device-operation unit 400, the speakers 500 and the low-frequency speakers 502 of the device 10 will now be described.

With reference to FIGS. 2 and 5, the top attachment panel 280 is attached to the top 102 of the speaker chassis 100 such that the top attachment panel 280 covers and closes the speaker chassis 100 at the top 102. The speaker chassis 100 and the top attachment panel 280 define an inner volume 110 and thereby provide an internal acoustic chamber. In the specific embodiment depicted in FIG. 5, the internal acoustic chamber has a vertically elongated cuboid shape. It is contemplated that in other embodiments of the present technology, the speaker chassis 100 may have more than four sidewalls 106, and in combination with the top attachment panel 280 covering and closing the speaker chassis 100 at the top 102, they may define alternative inner volume shapes, therefore providing alternative internal acoustic chambers resulting in different acoustic properties of the device 10.

During the assembly of the device 10, the top assembly 200 is attached to the speaker chassis 100. The top panel 226 of the top assembly 200 is fastened to the top attachment panel 280 through gaskets 285 (see FIG. 2) near each corner of the top attachment panel 280. The gaskets 285 vertically separate the top panel 226 and the top attachment panel 280 for providing necessary room for the annular support member 210, the light-emission ring 216, the light-diffusing ring 224 and the top assembly chassis 202 when the top assembly 200 is attached to the top attachment panel 280.

During the assembly of the device 10, the speakers 500 are attached to the speaker chassis 100. When attached to the respective lateral sidewalls 106 of the speaker chassis 100, the speakers 500 are vertically aligned with the respective apertures 108. When attached to the speaker chassis 100, the speakers 500 are facing outwardly away from the speaker chassis 100 and are facing away from one another. The speakers 500 are attached to the speaker chassis 100 in a fixed position with respect to one another.

During the assembly of the device 10, the low-frequency speaker 502 is abutted against a lip 103 (see FIG. 5) of the bottom 104 and is attached to the speaker chassis 100. When attached to the bottom 104, the low-frequency speaker 502 is horizontally aligned with the aperture 105 and is facing downwardly from the speaker chassis 100. The low-frequency speaker 502 is attached to the speaker chassis 100 in a fixed position with respect to the speakers 500.

When attached to the bottom 104 of the speaker chassis 100, the low-frequency speaker 502 is also facing away from the top assembly 200 and the plurality of microphones 250 (see FIG. 11). This positioning of the low-frequency speaker 502 allows increasing the average path that a sound wave generated by the low-frequency speaker 502 needs to travel in order to arrive at the plurality of microphones 250. Therefore, this positioning of the low-frequency speaker 502 allows reducing the contribution of the audio frequencies reproduced by the low-frequency speaker 502 to a given audio input being captured by the plurality of microphones 250.

During the assembly of the device 10, the bottom assembly 300 is attached to the speaker chassis 100. The support beams 304 of the bottom assembly chassis 302 are attached to the bottom 104 of the speaker chassis 100. When the bottom assembly chassis 302 and the low-frequency speaker 502 are attached to the speaker chassis 100, the concave parabolic cone protrusion 305 of the bottom assembly chassis 302 extends towards the low-frequency speaker 502.

When the bottom assembly chassis 302 and the low-frequency speaker 502 are attached to the speaker chassis 100, the concave parabolic cone protrusion 305 is horizontally aligned with the low-frequency speaker 502 such that a line 307, which is normal to the bottom assembly chassis 302 and which extends through a tip 309 of the concave parabolic cone protrusion 305, extends through a center 503 of the low-frequency speaker 502. The concave parabolic cone protrusion 305 aids in redirecting outwardly away from the device 10 the sound waves generated by the low-frequency speaker 502, instead of redirecting these sound waves by the bottom assembly chassis 302 upwardly back towards the low-frequency speaker 502. Redirection of the sound waves generated by the low-frequency speaker 502 outwardly away from the device 10 may increase the quality of a given audio output as perceived by the operator.

Figure 6:
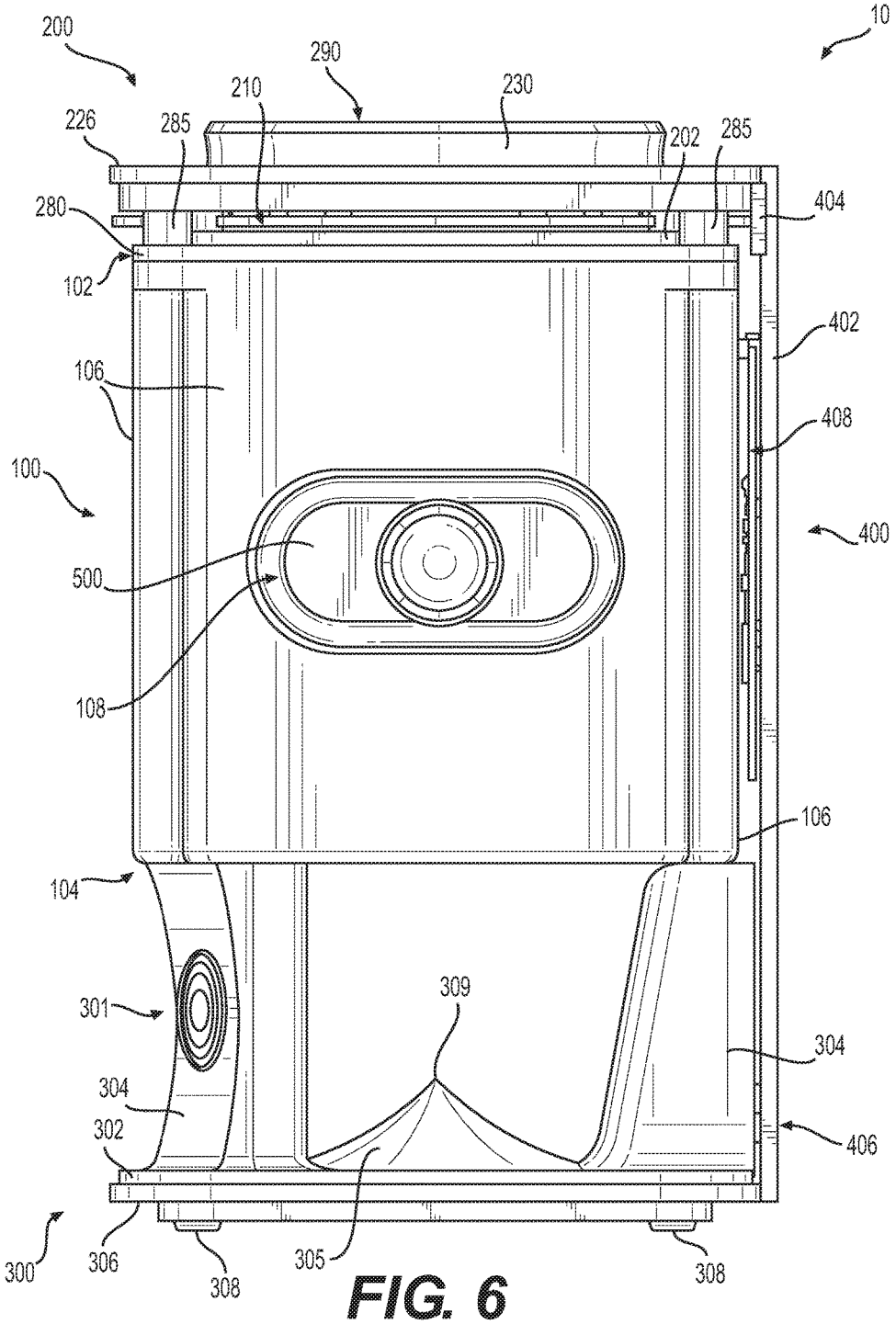
FIG. 6 is a left side elevation view of the device of FIG. 2.
Figure 7:
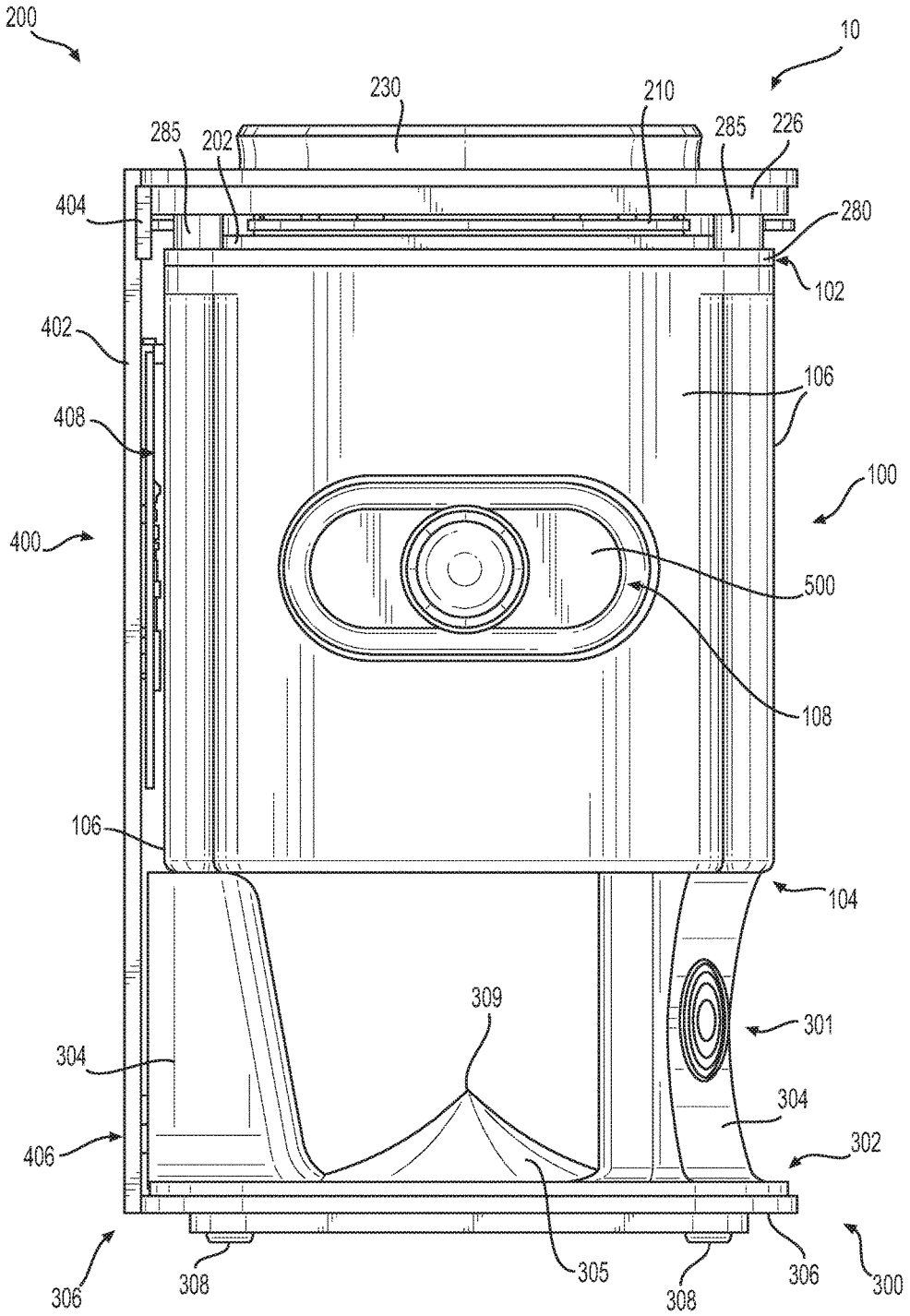
FIG. 7 is a right side elevation view of the device of FIG. 2.

During the assembly of the device 10, the processor 408 is attached to the support panel 402 (see FIGS. 6 and 7). The processor 408 extends vertically along the support panel 402. The support panel 402 is attached near the top thereof to the top assembly 200 by the support member 404. The support panel 402 vertically extends along the support beam 304 protruding at the back of the bottom assembly chassis 302 and is attached to the bottom assembly 300 near the bottom of the support panel 402.

When the support panel 402 is attached to the top assembly 200 and to the bottom assembly 300, the processor 408 is sandwiched between the back sidewall 106 of the speaker chassis 100 and the support panel 402. This positioning of the processor 408 may increase heat transfer from the processor 408 to its environment, thereby reducing the temperature of the processor 408 while in operation. It is contemplated that the support panel 402 may act as a radiator in order to increase heat transfer from the processor 408 to its environment.

Now that the assembly of the device 10 has been described, the operation of the device 10 will be described herein below.

It should be noted that the port circuit structure 409 housed in the base 306 is communicatively coupled to the plurality of ports 406 of the support panel 402 and to the processor 408. As such, the plurality of ports 406 in combination with the port circuit structure 409 and the processor 408 are configured to (i) provide electrical power to the device 10 for operation and (ii) enable wired connectivity of the device 10 with other electronic devices for cooperation of the device 10 with the other electronic devices.

It should also be noted that the beepers 301 are communicatively coupled to the processor 408. Recalling that the beepers 301 are supported by the support beams 304 protruding at the front of the bottom assembly chassis 302, this positioning of the beepers 301 near the front of the device 10 allows increasing the likelihood of the operator of the device 10 hearing the audible indications of at least some operations of the device 10 when the operator is located in front of the device 10.

Generally speaking, during operation of the device 10, the top assembly 200 is communicatively coupled to the processor 408 and is configured to (i) receive and transmit to the processor 408 indications of haptic interactions of the operator with the top assembly 200, (ii) capture audio inputs and transmit indications of audio inputs to the processor 408 and (iii) provide visual indications to the operator of the device 10.

The operator may interact with the top assembly 200 via the buttons 270. In other words, the top assembly 200 may receive indications of haptic interactions via the buttons 270. For example, by actuating a given button 270, the given button 270 contacts the respective button sensor 248 which sends an indication of the actuation of the given button 270 to the processor 408. In response, the processor 408 may execute an action associated with the actuation of the given button 270. In some implementations, upon actuation of a given button 270, the processor 408 may turn on/off the device 10 or may mute/un-mute the device 10.

The operator may also interact with the top assembly 200 via the side-ring 230. In other words, the top assembly 200 may receive indications of haptic interactions via the side-ring 230. For example, the operator can rotate the side-ring 230 about the vertical axis 555 in one direction or in the other direction. When the operator rotates the side-ring 230, the rotational motion of the side-ring 230, which is affixed to the inner socket roller 220, is transmitted to the pinion mechanism 236. When the pinion mechanism 236 rotates, the sensing rod 254 cooperates with the pinion mechanism 236 for detecting the angular position of the pinion mechanism 236 and transmits an indication thereof to the processor 408. In response, the processor 408 may execute an action associated with a current angular position of the pinion mechanism 236. In some implementations, upon receiving the indication of the current angular position of the pinion mechanism 236, the processor 408 may increase/decrease a volume level of audio outputs reproduced by the device 10. In other words, the processor 408 may be configured to modify the volume level of audio outputs reproduced by the device 10 when the angular position of the pinion mechanism 236 changes via the rotation of the side-ring 230 by the operator.

It is contemplated that, in alternative embodiments, various rotary encoders may be implemented in order to detect the current angular position of the pinion mechanism 236 and to transmit an indication thereof to the processor 408.

The top assembly 200 may capture audio inputs via the plurality of microphones 250. Generally speaking, a given audio input consists of sound waves of different audio frequencies that are propagated in proximity of the device 10. The given audio input may be representative of spoken utterances of the operator and may be indicative of spoken commands of the operator for controlling the device 10. The given audio input may also be representative of ambient sounds that can be attributed, in some circumstances, to the audio output of the device 10 and/or other sounds occurring in proximity of the device 10.

The top assembly 200 may also transmit indications of audio inputs to the processor 408 for processing thereof. The processor 408 stores and implements speech recognition algorithms and natural language processing algorithms for (i) extracting indications of spoken utterances of the operator from the indication of a given audio input captured by the plurality of microphone 250 and (ii) recognizing spoken commands of the operator of the device 10 based on the extracted indications of the spoken utterances.

This may allow the operator to control the device 10 to perform tasks based on the operator's spoken commands. It is contemplated that the processor 408 may also implement additional audio processing algorithms for processing of a given indication of audio input such as, but not limited to: acoustic echo cancellation processing, determining a sound source direction or direction of arrival, tracking of the utterance source, suppressing sounds coming from directions different from the direction of the utterance source, determining speech presence in the given indication of audio input, and the like.

The top assembly 200 may also provide visual indications to the operator of the device 10. For example, the processor 408 may be configured to turn on/off the plurality of LEDs 218 as well as to control a color of light to be emitted by the light-emission ring 216. Recalling that the light-diffusing ring 224 allows diffusing the light emitted by the plurality of LEDs 218, the top assembly 200 may display a continuous colored ring to the operator of the device 10.

Various colors of the continuous colored ring are representative of various visual indications for the operator of the device 10. For example, a first color of the continuous colored ring may be representative of a first mode of operation of the device 10, while a second color of the continuous colored ring may be representative of a second mode of operation of the device 10.

During operation of the device 10, the speakers 500 and the low-frequency speaker 502 are communicatively coupled to the processor 408 and are configured to reproduce audio outputs for the device 10. As previously mentioned, a given audio output is a combination of sound waves having various audio frequencies.

During operation of the device 10, the speakers 500 may generate sound waves of audio frequencies of a given audio output ranging from about 1 kHz to 20 kHz. The low-frequency speaker 502 may generate sound waves of audio frequencies of a given audio output ranging from about 100 Hz to 2 kHz.

However, it is contemplated that the ranges of the audio frequencies reproducible by the speakers 500 and the low-frequency speaker 502 may vary depending on inter alia a type of the given audio output to be reproduced by the device 10. This means that, during operation of the device 10, the processor 408 may be configured to control the ranges of the audio frequencies to be reproduced by the speakers 500 and the low-frequency speaker 502 based on a type of the given output to be reproduced by the device 10.

It should be noted that the device 10 is configured to operate in different output modes. In other words, the device 10 is configured to reproduce audio outputs in either a mono audio output mode or a stereo audio output mode. Generally speaking, audio outputs of the mono audio output type, sometimes referred to as "monaural outputs", are perceived by the operator as if the audio output is coming from one position, giving these audio outputs a "monaural effect" as persons skilled in the art will understand. Conversely, audio outputs of the stereo audio output type, sometimes referred to as "stereo outputs", are perceived by the operator as if the audio output is coming from distinct positions, giving these audio outputs a "stereo effect" as persons skilled in the art will understand.

In some embodiments, when a given audio output to be reproduced by the device 10 is of the mono audio output type, the processor 408 may instruct (i) the speakers 500 to reproduce audio frequencies ranging from 2 kHz to 20 kHz of the given audio output and (ii) the low-frequency speaker 502 to reproduce audio frequencies ranging from 100 Hz to 2 kHz.

In other embodiments, when the given audio output to be reproduced by the device 10 is of the stereo audio output type, the processor 408 may instruct (i) the speakers 500 to reproduce audio frequencies ranging from 1 kHz to 20 kHz of the given audio output and (ii) the low-frequency speaker 502 to reproduce audio frequencies ranging from 100 Hz to 1 kHz.

This means that, as previously mentioned, depending on the type of the given audio output to be reproduced by the device 10, the speakers 500 and the low-frequency speaker 502 may be instructed by the processor 408 to reproduce different ranges of audio frequencies of the given audio output.

During operation, the device 10 may be configured to reproduce an initial audio output. For example, the initial audio output may be representative of a given song that the operator of the device 10 wants to hear. To that end, the processor 408 may be configured to transmit at least one audio signal to the two speakers 500 for reproducing at least partially the initial audio output.

In some embodiments, if the initial audio output to be reproduced is of the mono audio output type, the processor 408 may be configured to transmit an identical audio signal to each one of the speakers 500 for generating sound waves of generally high audio frequencies of the initial audio output. Transmitting the identical signal to each one of the speakers 500 for reproducing at least partially the initial audio output will give the initial audio output the "monaural effect" as mentioned above.

In other embodiments, if the initial audio output to be reproduced is of the stereo audio output type, the processor 408 may be configured to transmit a respective audio signal to each one of the speakers 500 for generating sound waves of generally high audio frequencies of the initial audio output. The respective audio signals transmitted to each one of the speakers 500 are different from one another such that the initial audio output will be given the "stereo effect" as mentioned above.

Additionally, the processor 408 may be configured to transmit another audio signal to the low-frequency speaker 502 for reproducing sound waves of generally low audio frequencies of the initial audio output.

For explanation purposes only, let it be assumed that the initial audio output to be reproduced consists of sound waves of audio frequencies ranging from 100 Hz to 20 kHz.

If the initial audio output to be reproduced is of the mono audio output type, the identical audio signal transmitted to each one of the speakers 500 will instruct each of the speakers 500 to generate identical sound waves of audio frequencies of the initial audio output ranging from 2 kHz to 20 kHz. In other words, when the initial audio output to be reproduced is of the mono audio output type, both of the speakers 500 function as a single audio output source generating audio frequencies ranging from 2 kHz to 20 kHz, since they both receive the identical audio signal from the processor 408. Also, if the initial audio output to be reproduced is of the mono audio output type, the another audio signal transmitted to the low-frequency speaker 502 will instruct the low-frequency speaker 502 to generate sound waves of audio frequencies of the initial audio output ranging from 100 Hz to 2 kHz.

Conversely, if the initial audio output to be reproduced is of the stereo audio output type, the respective audio signals transmitted to the speakers 500 will instruct each of the speakers 500 to reproduce respective sound waves of audio frequencies of the initial audio output ranging from 1 kHz to 20 kHz. In other words, when the initial audio output to be reproduced is of the stereo audio output type, each one of the speakers 500 functions as a separate audio output source generating audio frequencies ranging from 1 kHz to 20 kHz, since each one of the speakers 500 receives different audio signals from the processor 408. Also, if the initial audio output to be reproduced is of the stereo audio output type, the another audio signal transmitted to the low-frequency speaker 502 will instruct the low-frequency speaker 502 to generate sound waves of audio frequencies of the initial audio output ranging from 100 Hz to 1 kHz.

It is contemplated that if the initial audio output to be reproduced is of the stereo audio output type, the sound waves of audio frequencies of the initial audio output reproduced by the speakers 500 may consist of a broader range of audio frequencies than if the initial audio output to be reproduced is of the mono audio output type. It is also contemplated that if the initial audio output to be reproduced is of the stereo audio output type, the sound waves of audio frequencies of the initial audio output to be reproduced by the low-frequency speaker 502 may consist of a narrower range of audio frequencies than if the initial audio output to be reproduced is of the mono audio output type.

During operation, the processor 408 is also configured to detect the volume level of the initial audio output. In some embodiments, the processor 408 may be configured to analyze at least one audio signal transmitted to the speakers 500 for reproducing the initial audio output in order to detect the volume level of the initial audio output. Indeed, it is contemplated that the at least one audio signal transmitted to the speakers 500 may comprise information indicative of the volume level of the initial audio output that is reproduced by the speakers 500.

In other embodiments, the processor 408 may detect the volume level of the audio input, instead of, or in addition to, detecting the volume level of the initial audio output, by analysing data received from the top assembly 200.

As previously mentioned, the plurality of microphones 250 may capture a given audio input which at least partially consists of the initial audio output reproduced by the device 10 and may transmit an indication of the given audio input to the processor 408. The processor 408 may store and implement volume level detection algorithms for analysing the indication of the given audio input transmitted thereto by the plurality of microphones 250 and thereby detecting the volume level of the given audio input.

During operation, the processor 408 is also configured to compare the volume level of the initial audio output to a volume level threshold. The volume level threshold is representative of a given value of the volume level of a given audio input at which the processor 408 (*i*) can no longer extract indications of spoken utterances of the operator from the indication of the given audio input received from the plurality of microphones 250 and (ii) cannot recognize spoken commands of the operator of the device 10.

Therefore, it can be said that the volume level threshold is at least partially predetermined based on the volume level of speech of the operator. In other words, if the volume level of the initial audio output is superior to the volume level threshold, the processor 408 cannot extract indications of spoken utterances from the given audio input and, therefore, cannot analyze them for recognizing spoken commands of the operator.

It is contemplated that, in some embodiments of the present technology, the processor 408 may be configured to compare the volume level of the given audio input to the volume level threshold, instead of comparing the volume level of the initial audio output to the volume level threshold.

It should be noted that the volume level of the initial audio output and/or the volume level of the given audio input might be referred herein as a "current volume level" since they are both indicative of a volume level of sound waves currently propagating in proximity of the device 10.

During operation, the processor 408 of the device 10 is also configured to control the reproduction of the initial audio output based on the comparison of the current volume level to the volume level threshold. Indeed, depending on whether the current volume level is inferior or superior to the volume level threshold, the processor 408 is configured to selectively transmit audio signals to the speakers 500 and to the low-frequency speaker 502 for reproducing a modified audio output being of the mono or of the stereo audio output type.

Let it be assumed that the current volume level is inferior to the volume level threshold. In response, the processor 408 is configured to selectively transmit the identical audio signal to both of the speakers 500 for reproducing at least partially the modified audio output. As previously mentioned, since both of the speakers 500 receive the identical audio signal, the modified audio output reproduced by the device 10 will be of the mono audio output type.

In this case, since the current volume level is inferior to the volume level threshold, the processor 408 is capable of extracting from the indication of the given audio input the indication of spoken utterances and may analyze the indication of spoken utterances in order to recognize spoken commands of the operator. As such, while the device 10 is reproducing the modified audio output being of the mono audio output type, the device 10 is able to capture and recognize spoken commands of the operator for controlling the device 10.

Now let it be assumed that the current volume level is superior to the volume level threshold. In response, the processor 408 is configured to selectively transmit to each one the speakers 500 a respective audio signal for reproducing at least partially the modified audio output. As previously mentioned, since both of the speakers 500 receive respective audio signals being different from one another, the modified audio output reproduced by the device 10 will be of the stereo audio output type.

In this case, since the current volume level is superior to the volume level threshold, the processor 408 is not capable of extracting from the indication of the given audio input the indication of spoken utterances and cannot analyze the indication of spoken utterances in order to recognize spoken commands of the operator. As such, the processor 408 may be configured to mute the plurality of microphones 250 since, even though they can capture the given audio input, the indication of spoken utterances cannot be extracted from the indication of the given audio input transmitted to the processor 408 and, therefore, cannot be analyzed for recognizing spoken commands.

By muting the plurality of microphones 250 when the current volume level is superior to the volume level threshold, the processor 408 can reduce power usage of the device 10 while reproducing loud audio outputs.

The muting operation of the plurality of microphones 250 may be executed by the processor 408 in two different modes. In a first mode, the processor 408 may be configured to execute a "software muting" of the plurality of microphones 250. In other words, the processor 408 may be configured not to execute speech recognition and natural language processing algorithms necessary for recognizing spoken commands of the operator. In this first mode, even though the plurality of microphones 250 are able to capture the given audio input, the processor 408 will not be configured to extract indications of spoken utterances from the indication of the given audio input and will not be configured to recognize spoken commands. Executing the muting of the plurality of microphones 250 in the first mode allows reducing the amount of processing resources necessary for operation of the device 10.

In a second mode, the processor 408 may be configured to execute a "hardware and software muting" of the plurality of microphones 250. In other words, the processor 408 may be configured to stop supplying power to the plurality of microphones 250 so that, not only that the processor 408 will not be configured to extract indications of spoken utterances from the indication of the given audio input and will not be configured to recognize spoken commands, but the plurality of microphones 250 will no longer be able to capture the given audio input and transmit the indication of the given audio input to the processor 408. Executing the muting of the plurality of microphones 250 in the second mode allows not only reducing the amount of processing resources necessary for operation of the device 10, but also allows reducing the power consumption of the device 10 during operation.

In some embodiments of the present technology, the processor 408 of the device 10 may be configured to execute a method 1200 of selectively modifying the initial audio output of the device 10. The method 1200 will now be described in greater detail.

Step 1202

The method 1200 begins with step 1202 where the processor 408 is configured to detect the volume level of the initial audio output reproducible by the at least two speakers 500. The initial audio output may be representative of a song that the operator of the device 10 is desirous of hearing.

For example, the device 10 may have been playing the song for the operator who decided that the song was either too loud or not loud enough. As a result, the operator may have rotated the side-ring 230 of the device 10 in order to adjust the volume level at which she/he wants to hear the song based on her/his preference. As such, in this example, the song played at a newly selected volume level by the operator may be the initial audio output.

In some embodiments, the initial audio output may be of the mono audio output type. In other embodiments, the initial audio output may be of the stereo audio output type.

In some embodiments, the processor 408 may analyze at least one audio signal transmitted to the speakers 500 for reproducing the initial audio output in order to detect the volume level of the initial audio output. Indeed, it is contemplated that the at least one audio signal transmitted to the speakers 500 may comprise information indicative of the volume level of the initial audio output that is reproduced by the speakers 500.

In other embodiments, the processor 408 may detect the volume level of the audio input, instead of, or in addition to, detecting the volume level of the initial audio output, by receiving data transmitted thereto by the plurality of microphones 250.

For example, the plurality of microphones 250 may capture a given audio input which at least partially consists of the initial audio output reproduced by the device 10. Indeed, the given audio input may consist in part of the song being played by the device 10 and in part of voice sounds emitted by the operator trying to sing the lyrics of the song. The plurality of microphones 250 may transmit data indicative of this audio input to the processor 408. The processor 408 may detect the volume level of the audio input via an analysis of the data received from the plurality of microphones 250.

It should be noted that the volume level of the initial audio output and/or the volume level of the given audio input might be referred herein as the "current volume level" since both are indicative of a volume level of sound waves currently propagating in proximity of the device 10.

Step 1204

The method 1200 continues to step 1204 where the processor 408 is configured to compare the current volume level to a volume level threshold.

The volume level threshold is representative of a given value of the current volume level at which the processor 408 can no longer extract indications of spoken utterances of the operator from the indication of the given audio input transmitted by the plurality of microphones 250 and cannot recognize spoken commands of the operator of the device 10.

As previously mentioned, the processor 408 stores and implements speech recognition algorithms and natural language processing algorithms for extracting indications of spoken utterances of the operator and for recognizing spoken commands of the operator of the device 10 based on the extracted indications of spoken utterances. This may allow the operator to control the device 10 to perform tasks based on the operator's spoken commands. The tasks that are performable by the device 10 based on operators' spoken commands are not particularly limiting but, as an example, these tasks may comprise:

- wirelessly connecting the device 10 to other electronic devices;
- displaying information from the device 10 on other electronic devices;
- increasing/decreasing volume level of a given audio output being reproduced by the device 10;
- provide search results via a given audio output to be reproduced by the device 10 in response to a spoken query provided by the operator;
- enter/exit standby mode;
- turn on/off the device 10;
- mute/un-mute the device 10;
- and the like.

Therefore, if the current volume level is superior to the volume level threshold, the processor 408 may not be able to extract the spoken utterances from the indication of the given audio input for recognizing spoken commands and performing the tasks that the operator desires it to perform.

In some embodiments, the volume level threshold may be at least partially predetermined based on the volume level of speech of the operator.

Step 1206

The method 1200 ends at step 1206 with the processor 408, based on the comparison of the current volume level to the volume level threshold, being configured to control reproduction of the initial audio output by the at least two speakers 500. Based on the comparison of the current volume level to the volume level threshold, the processor 408 may selectively reproduce (i) the modified audio output being of the mono audio output type or (ii) the modified audio output being of the mono audio output type.

The processor 408, responsive to the current volume level being inferior to the volume level threshold, may transmit an identical audio signal to each one of the at least two speakers 500 for reproducing the modified audio output being of the mono audio output type. This means that, if the current volume level is inferior to the volume level threshold, the device 10 will play the song at the newly selected volume level by the operator in a mono mode such that the song is perceived by the operator as if the song is being played from one position, giving the song the "monaural effect".

In some embodiments, reproducing the modified audio output being of the mono audio output type (e.g., playing the song in the mono mode) may facilitate extraction of the indication of spoken utterances from the indication of the given audio input for analysis and recognition of potential spoken commands of the operator while the modified audio output is being reproduced.

The processor 408, responsive to the current volume level being superior to the volume level threshold, may transmit respective audio signals to the at least two speakers 500, where the respective audio signals being different from one another, for reproducing the modified audio output being of a stereo audio output type. This means that, if the current volume level is superior to the volume level threshold, the device 10 will play the song at the newly selected volume level by the operator in a stereo mode such that the song is perceived by the operator as if the song is being played from distinct positions, giving the song the "stereo effect".

In some embodiments, reproducing the modified audio output being of the stereo audio output type (e.g., playing the song in the stereo mode) may increase the operator's satisfaction since songs played in stereo mode, as opposed to being played in mono mode, are generally perceived as of a higher quality due to the "stereo effect" given to the songs. Indeed, by increasing the volume level of the song being played, the operator indicates that she/he desires to enjoy the song, instead of providing spoken commands to the device 10, and therefore, desires a more enjoyable experience that the "stereo effect" can provide to the operator.

Therefore, in other embodiments, responsive to the current volume level being superior to the volume level threshold, the processor 408 may be configured to mute the plurality of microphones 250.

In additional embodiments, the processor 408 may be configured to execute software muting of the plurality of microphones 250. In other words, the processor 408 may be configured not to execute speech recognition and natural language processing algorithms necessary for recognizing spoken commands of the operator. In this first mode, even though the plurality of microphones 250 are able to capture the given audio input, the processor 408 will not be configured to extract the indication of spoken utterances from the indication of the given audio input and will not be configured to recognize spoken commands.

In alternative embodiments, the processor 408 may be configured to not only execute software muting of the plurality of microphones 250, but may also execute hardware muting of the plurality of microphones 250. In other words, the processor 408 may be configured to stop supplying power to the plurality of microphones 250 so that, not only that the processor 408 will not be configured to extract the indication of spoken utterances from the indication of the given audio input and will not be configured to recognize spoken commands, but the plurality of microphones 250 will no longer be able to capture the given audio input and transmit the indication of the given audio input to the processor 408.

Figure 13:
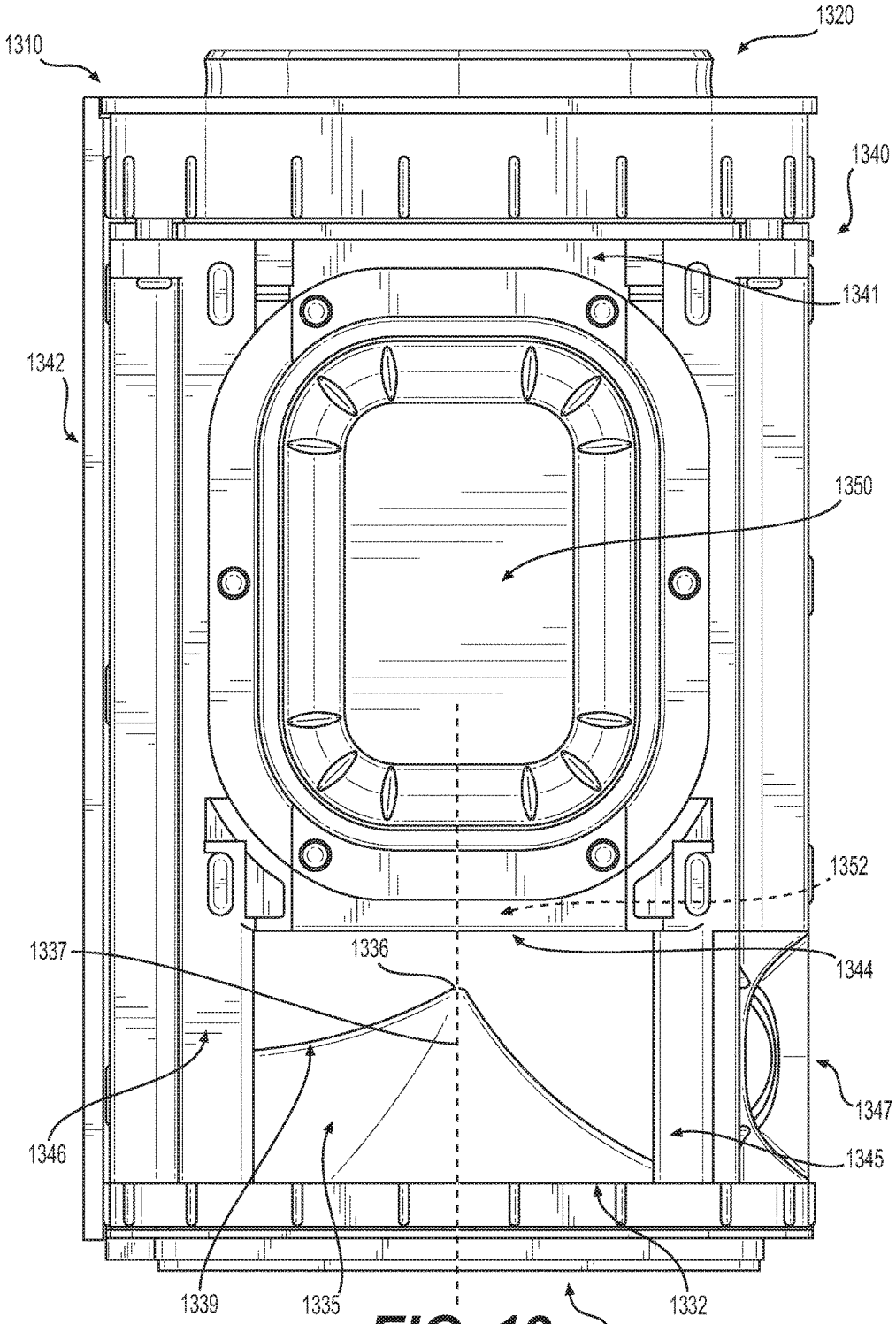
FIG. 13 is a right side elevation view of a device implemented according to an alternative embodiment of the present technology, the device shown without a cover and without a grill cover.
Figure 14:
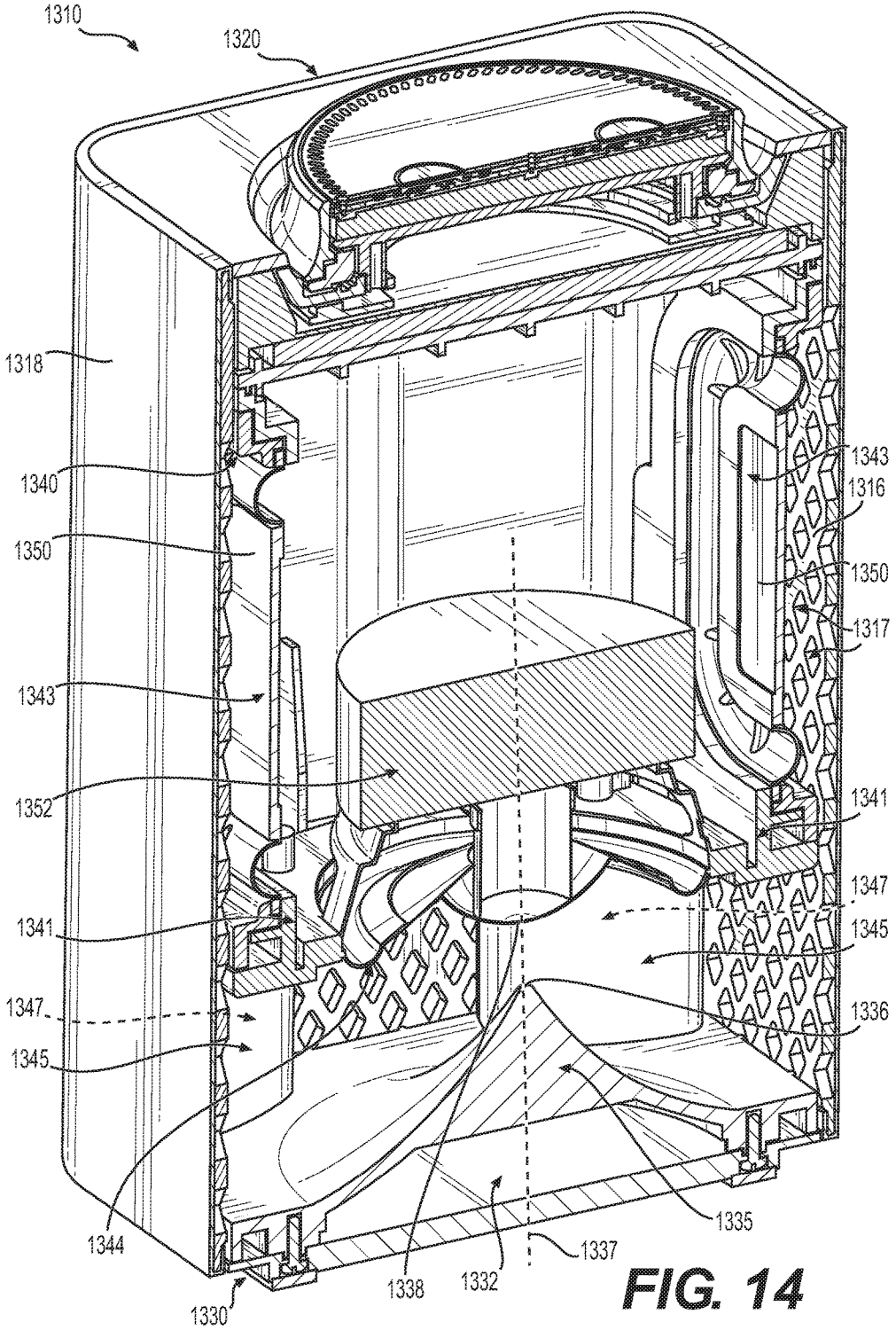
FIG. 14 is a cross-sectional view of a front cross-section of the device of FIG. 13, the device shown with the cover and the grill cover, the cross-section taken through a line extending laterally across the device and being equidistant from front and back sides of the device.

With reference to FIGS. 13 and 14, there is depicted an alternative embodiment of the present technology. There is depicted an alternative device 1310 having a top, a bottom and four sides. Similarly to the device 10, the alternative device 1310 is configured to (i) reproduce audio outputs being representative of, for example, songs that the operator wants to hear, (ii) capture audio inputs which can be representative of spoken utterances of the operator and (iii)

perform tasks based on operator's commands What follows is the description of some of the differences between the alternative device 1310 and the device 10.

The alternative device 1310 has an alternative top assembly 1320. The alternative top assembly 1320 is operable and configured similarly to the top assembly 200 of the device 10. As such, the alternative top assembly 1320 is configured to (i) receive and transmit indications of haptic interactions of the operator of the alternative device 1310 with the alternative top assembly 1320, (ii) capture and transmit indication of audio inputs of the alternative device 1310 and (iii) provide visual indications to the operator.

The alternative device 1310 also has an alternative support panel 1342 at the back thereof. The alternative support panel 1342 is operable and configured similarly of the support panel 402 of the device 10. The alternative support panel 1342 is enveloped by an alternative cover 1318 that is positioned about the alternative device 1310 for protecting internal components of the alternative device 1310 from its environment. The alternative support panel 1342 is also enveloped by a grill cover 1316 that is positioned inwardly of the alternative cover 1318 and about the alternative device 1310. The grill cover 1316 defines a plurality of apertures 1317 for controlling quality of a given audio output reproduced by the alternative device 1310.

The alternative device 1310 also has an alternative bottom assembly 1330. The alternative bottom assembly 1330 includes an alternative bottom assembly chassis 1332 which has a conic-type protrusion 1335 extending upwardly from the alternative bottom assembly chassis 1332. The conic-type protrusion 1335 and the alternative bottom assembly chassis 1332 are integrally formed, but this does not have to be the case in each and every embodiment of the present technology.

It is contemplated that the concave parabolic cone protrusion 305 of the device 10 may be substituted by the conic-type protrusion 1335 of the alternative device 1310 without departing from the scope of the present technology.

The alternative device 1310 also has an alternative speaker chassis 1340. The alternative speaker chassis 100 has four sidewalls which include two lateral sidewalls 1341. Each lateral sidewall 1341 defines a respective aperture 1343 for accommodating alternative speakers 1350 of the alternative device 1310, similarly to how the speakers 500 are accommodated by the apertures 108 of the speaker chassis 100. The alternative speaker chassis 1340 defines an aperture 1344 at the bottom thereof for accommodating an alternative low-frequency speaker 1352 of the device 1310, similarly to how the low-frequency speaker 502 is accommodated by the aperture 105 of the speaker chassis 100.

The alternative speaker chassis 1340 has two front support beams 1345 and a back support wall 1346. The front support beams 1345 protrude downwardly from the alternative speaker chassis 1340 near a respective front corner thereof. The back support wall 1346 protrudes downwardly from the alternative speaker chassis 1340 near the back thereof. The alternative speaker chassis 1340, the front support beams 1345 and the back support wall 1346 are integrally formed. The front support beams 1345 are adapted to support alternative beepers 1347.

The alternative top assembly 1320 is attached on top of the alternative speaker chassis 1340 and the alternative support panel 1342 is attached at the back of the alternative speaker chassis 1340. The alternative bottom assembly chassis 1330 is attached to the alternative speaker chassis 1340 by the front support beams 1345 and the back support wall 1346.

When the alternative bottom assembly chassis 1330 is attached to the alternative speaker chassis 1340 and when the alternative beepers 1347 are supported by the front support beams 1345, the alternative beepers 1347 are angled laterally away from a lateral-center line of the alternative bottom assembly chassis 1330, which is equidistant from the lateral sides of the alternative bottom assembly chassis 1330. When the alternative beepers 1347 are so-angled, the audible indications of at least some operations of the alternative device 1310 reproduced by the alternative beepers 1347 are directed generally forward of the alternative device 1310 so as to be more easily heard by the operator if the operator is located generally in front of the alternative device 1310.

It is contemplated that the beepers 301 of the device 10 may be laterally angled away from a lateral-center line of the bottom assembly chassis 302, similarly to how the alternative beepers 1347 are laterally angled away from the lateral-center line of the alternative bottom assembly chassis 1330.

When the alternative bottom assembly chassis 1330 and the alternative low-frequency speaker 1352 are attached to the alternative speaker chassis 1340, the conic-type protrusion 1335 is horizontally aligned with the alternative low-frequency speaker 1352 such that a line 1337, which is normal to the alternative bottom assembly chassis 1330 and which extends through a tip 1336 of the conic-type protrusion 1335, extends through a center 1338 of the alternative low-frequency speaker 1352.

Similarly to the concave parabolic cone protrusion 305 of the device 10, the conic-type protrusion 1335 aids in redirecting the sound waves generated by the alternative low-frequency speaker 1352. However, unlike the concave parabolic cone protrusion 305 of the device 10, the conic-type protrusion 1335 has an elevated back portion 1339 which extends (i) longitudinally along the lateral-center line of the alternative bottom assembly chassis 1330 and (ii) towards the back support wall 1346. The elevated back portion 1339 of the conic-type protrusion 1335 allows redirecting at least some sound waves, which would be otherwise redirected backwardly away from the device 10 by the concave parabolic cone protrusion 305, laterally away from the alternative device 1310.

In other words, instead of redirecting the sound waves generated by the low-frequency speaker 502 forwardly, laterally and backwardly away from the device 10 such as the redirection by the concave parabolic cone protrusion 305, the conic-type protrusion 1335 redirects the sound waves generated by the alternative low-frequency speaker 1352 forwardly and laterally away from the alternative device 1310 (not backwardly away). Redirection of the sound waves generated by the alternative low-frequency speaker 1352 by the conic-type protrusion 1335 may increase the quality of a given audio output as perceived by the operator if the operator is located generally in front of the alternative device 1310.

In some cases, the alternative device 1310 may be placed by the operator in a corner of the room and/or against a wall of the room. In these cases, it might be unnecessary to direct sound indications (e.g., a given audio output and/or the audible indications) backwardly away from the alternative device 1310 since the operator cannot be located behind the alternative device 1310. Therefore, in such circumstances, the alternative beepers 1347 being laterally angled away from the lateral-center line of the alternative bottom assembly chassis 1330 and the conic-type protrusion 1335 allow the alternative device 1310 to direct the sound indications (e.g., a given audio output and the audible indications)

towards the operator in a more efficient manner since the operator is likely to be located generally forward of the alternative device 1310, which generally coincides with the direction of the sound indications generated by the alternative device 1310.

Modifications and improvements to the above-described implementations of the present may become apparent to those skilled in the art. The foregoing description is intended to be exemplary rather than limiting. The scope of the present is therefore intended to be limited solely by the scope of the appended claims.

What is claimed is:

1. A method of selectively modifying an initial audio output of a device, the device comprising at least two speakers communicatively coupled to a processor, the method comprising:

detecting, by the processor, a volume level of the initial audio output reproducible by the at least two speakers;

comparing, by the processor, the volume level to a volume level threshold;

based on the comparison of the volume level to the volume level threshold, controlling, by the processor, reproduction of the initial audio output by the at least two speakers by a selective execution of:

responsive to the volume level being inferior to the volume level threshold, transmitting, by the processor, an identical audio signal to each one of the at least two speakers for reproducing a modified audio output, the modified audio output being of a mono audio output type; and responsive to the volume level being superior to the volume level threshold, transmitting, by the processor, respective audio signals to the at least two speakers for reproducing the modified audio output, the respective audio signals being different from one another, the modified audio output being of a stereo audio output type.

2. The method of claim 1, wherein the initial audio output is of the mono audio output type.

3. The method of claim 1, wherein the initial audio output is of the stereo audio output type.

4. The method of claim 1, wherein the detecting the volume level of the initial audio output comprises analyzing at least one audio signal transmitted to the at least two speakers for reproducing the initial audio output.

5. The method of claim 1, wherein the device further comprises a microphone communicatively coupled to the processor, and wherein based on the comparison of the volume level to the volume level threshold and responsive to the volume level being superior to the volume level threshold, the method further comprises muting, by the processor, the microphone.

6. The method of claim 5, wherein muting the microphone comprises executing, by the processor, software muting of the microphone.

7. The method of claim 6, wherein muting the microphone further comprises executing, by the processor, hardware muting of the microphone.

8. The method of claim 1, wherein the modified audio output reproducible by the at least two speakers being of the stereo audio output type has a broader range of audio frequencies than the modified audio output reproducible by the at least two speakers being of the mono audio output type.

9. The method of claim 5, wherein the volume level threshold is predetermined based on at least a volume level of speech of an operator of the device.

10. The method of claim 1, wherein the method further comprises providing to an operator of the device a visual indication of a type of the modified audio output.

11. A device comprising:

a speaker chassis having a top, a bottom and sidewalls, the sidewalls including two opposite sidewalls each having an aperture;

at least two speakers, each of the two speakers inserted into a respective aperture of opposite sidewalls such that each one of the at least two speakers is facing outwardly from the speaker chassis; and a processor connected to the speaker chassis and being communicatively coupled to:

the at least two speakers; and the processor configured to:

transmit at least one audio signal to the at least two speakers for reproducing an initial audio output by the at least two speakers;

detect a volume level of the initial audio output;

compare the volume level to a volume level threshold; and based on a comparison of a volume level of the initial audio output to the volume level threshold, control the reproduction of the initial audio output by selectively transmitting:

responsive to the volume level being inferior to the volume level threshold, an identical audio signal to each one of the at least two speakers for reproducing a modified audio output, the modified audio output being of a mono audio output type; and responsive to the volume level being superior to the volume level threshold, respective audio signals to the at least two speakers for reproducing the modified audio output, the respective audio signals being different from one another, the modified audio output being of a stereo audio output type.

12. The device of claim 11, wherein the device further comprises a top assembly connected to the top of the speaker chassis and communicatively coupled to the processor, the top assembly configured to receive indications of haptic interactions of an operator with the top assembly.

13. The device of claim 11, wherein the top assembly comprises a microphone communicatively coupled to the processor, and wherein based on the comparison of the volume level to the volume level threshold and responsive to the volume level being superior to the volume level threshold, the processor is further configured to mute the microphone.

14. The device of claim 13, wherein to mute the microphone, the processor is configured to execute software muting of the microphone.

15. The device of claim 14, wherein to mute the microphone, the processor is configured to execute hardware muting of the microphone.

16. The device of claim 11, wherein the modified audio output reproducible by the at least two speakers being of the stereo audio output type has a broader range of audio frequencies than the modified audio output reproducible by the at least two speakers being of the mono audio output type.

17. The device of claim 11, wherein the volume level threshold is predetermined based on at least an audible volume level of speech of an operator of the device by the microphone.

18. The device of claim 12, wherein the top assembly further provides to the operator of the device a visual indication of a type of the modified audio output.

19. The device of claim 11, wherein the device further comprises a low-frequency speaker connected to the bottom of the speaker chassis such that the low-frequency speaker is facing downwardly from the speaker chassis, and wherein the processor is communicatively coupled to the low-frequency speaker.

* * * * *